US011731417B2

(12) United States Patent
Shimizu et al.

(10) Patent No.: US 11,731,417 B2
(45) Date of Patent: Aug. 22, 2023

(54) LIQUID EJECTING APPARATUS AND METHOD OF DRIVING LIQUID EJECTING HEAD

(71) Applicant: Seiko Epson Corporation, Tokyo (JP)

(72) Inventors: Toshihiro Shimizu, Fujimi (JP); Koji Sumi, Shiojiri (JP)

(73) Assignee: SEIKO EPSON CORPORATION

( * ) Notice: Subject to any disclaimer, the term of this patent is extended or adjusted under 35 U.S.C. 154(b) by 65 days.

(21) Appl. No.: 17/104,161

(22) Filed: Nov. 25, 2020

(65) Prior Publication Data

US 2021/0162744 A1 Jun. 3, 2021

(30) Foreign Application Priority Data

Nov. 29, 2019 (JP) ..... 2019-216452

(51) Int. Cl.
*B41J 29/38* (2006.01)
*B41J 2/045* (2006.01)

(52) U.S. Cl.
CPC ..... *B41J 2/04541* (2013.01); *B41J 2/04581* (2013.01)

(58) Field of Classification Search
CPC ..... B41J 2/04596; B41J 2/04581
See application file for complete search history.

(56) References Cited

U.S. PATENT DOCUMENTS

2008/0106557 A1* 5/2008 Sayama ..... B41J 2/04596 29/890.1
2009/0073207 A1* 3/2009 Takeuchi ..... B41J 2/04581 347/11
2011/0063348 A1* 3/2011 Mita ..... B41J 2/04581 347/68

FOREIGN PATENT DOCUMENTS

JP 2011-056913 A 3/2011

* cited by examiner

*Primary Examiner* — Lam S Nguyen
(74) *Attorney, Agent, or Firm* — Harness, Dickey & Pierce, P.L.C.

(57) ABSTRACT

A liquid ejecting apparatus includes: a liquid ejecting head that includes a flow path formation substrate in which a pressure chamber communicating with a nozzle is formed, a vibration plate, and a piezoelectric actuator having a first electrode, a piezoelectric layer, and a second electrode; and a drive unit that supplies a drive signal for driving the piezoelectric actuator, in which the piezoelectric actuator includes an active portion, the active portion is extended from an edge portion, which is a region other than a central portion of a region facing the pressure chamber, to the outside of the pressure chamber, and the drive signal includes a contraction element that contracts the pressure chamber from a reference volume of the pressure chamber when no electric field is applied to the piezoelectric layer, and an expansion element that expands the pressure chamber contracted by the contraction element.

6 Claims, 13 Drawing Sheets

LIQUID EJECTING APPARATUS AND METHOD OF DRIVING LIQUID EJECTING HEAD

The present application is based on, and claims priority from JP Application Serial Number 2019-216452, filed Nov. 29, 2019, the disclosure of which is hereby incorporated by reference herein in its entirety.

BACKGROUND

1. Technical Field

The present disclosure relates to a liquid ejecting apparatus including a liquid ejecting head which ejects a liquid, and a method of driving the liquid ejecting head.

2. Related Art

A liquid ejecting head, in which a vibration plate is provided at a flow path formation substrate at which a pressure chamber is formed and a piezoelectric actuator is provided at the vibration plate, used in a liquid ejecting apparatus is known. It is known that the piezoelectric actuator is formed by stacking a first electrode, a piezoelectric layer, and a second electrode from the vibration plate side.

As one form of the piezoelectric actuator, a piezoelectric actuator in which an active portion of a piezoelectric actuator is provided at an edge portion of a region of a vibration plate facing a pressure chamber (hereinafter, referred to as a movable region), and the active portion is not provided at a central portion of the movable region is known (for example, see JP-A-2011-56913). That is, the piezoelectric actuator has a configuration in which the annular active portion is provided over the vibration plate so as to overlap the edge portion in plan view, and the vibration plate is exposed without the active portion being provided at the central portion.

In such an annular piezoelectric actuator, it is proposed that the vibration plate is in a state of being bent in a convex shape on a side opposite to the pressure chamber as initial deflection before ejection and the pressure chamber side has a concave shape by supplying a drive signal, and then the vibration plate is deformed in a convex shape toward the pressure chamber side, so that a liquid droplet such as an ink droplet is ejected from a nozzle (see, for example, JP-A-2011-56913).

However, in order to make the initial deflection of the vibration plate to be convex toward the pressure chamber side, it is necessary to execute one or both of that a member having compressive stress is introduced into a member constituting the vibration plate and that a member having patterned tensile stress, which is not a beam shape, is disposed in a region facing the pressure chamber as the member constituting the vibration plate.

As described above, even when the member having compressive stress is introduced into the member constituting the vibration plate, there is a problem that it cannot be said that the initial deflection is necessarily deformed to be convex toward the pressure chamber side and it is difficult to control the initial deflection of the vibration plate.

Further, even when the member having patterned tensile stress, which is not a beam shape, is disposed in the member constituting the vibration plate, the tensile stress is further increased by displacement generated when an electric field is applied to the piezoelectric actuator, so that there is a problem that the piezoelectric actuator is easily broken.

Further, when a width of the pressure chamber is widened so as to increase a weight of the ejected liquid droplet, there are problems that stress at the vibration plate increases and the vibration plate is more easily broken.

Such a problem is not limited to an ink jet recording apparatus which ejects ink, and also exists in a liquid ejecting apparatus which ejects a liquid other than ink.

SUMMARY

An advantage of some aspects of the present disclosure is that there are provided a liquid ejecting apparatus and a method of driving a liquid ejecting head capable of improving a displacement amount of a piezoelectric actuator and improving a disposition density of a pressure chamber.

According to an aspect of the present disclosure, there is provided a liquid ejecting apparatus including: a liquid ejecting head that includes a flow path formation substrate in which a pressure chamber communicating with a nozzle is formed, a vibration plate formed on one surface side of the flow path formation substrate, and a piezoelectric actuator having a first electrode, a piezoelectric layer, and a second electrode that are formed on a surface side of the vibration plate opposite to the flow path formation substrate; and a drive unit that supplies a drive signal for driving the piezoelectric actuator, in which the piezoelectric actuator includes an active portion in which the piezoelectric layer is interposed between the first electrode and the second electrode, in plan view from a stacking direction of the first electrode, the piezoelectric layer, and the second electrode, the active portion is extended from an edge portion, which is a region other than a central portion of a region facing the pressure chamber, to the outside of the pressure chamber, and the drive signal includes a contraction element that contracts the pressure chamber from a reference volume of the pressure chamber when no electric field is applied to the piezoelectric layer, and an expansion element that expands the pressure chamber contracted by the contraction element.

According to another aspect of the present disclosure, there is provided a method of driving a liquid ejecting head, the liquid ejecting head including a flow path formation substrate in which a pressure chamber communicating with a nozzle is formed, a vibration plate formed on one surface side of the flow path formation substrate, and a piezoelectric actuator having a first electrode, a piezoelectric layer, and a second electrode that are formed on a surface side of the vibration plate opposite to the flow path formation substrate, in which the piezoelectric actuator includes an active portion in which the piezoelectric layer is interposed between the first electrode and the second electrode, and in plan view from a stacking direction of the first electrode, the piezoelectric layer, and the second electrode, the active portion is extended from an edge portion, which is a region other than a central portion of a region facing the pressure chamber, to the outside of the pressure chamber, the method including: driving the piezoelectric actuator by a drive signal including a contraction element that contracts the pressure chamber from a reference volume of the pressure chamber when no electric field is applied to the piezoelectric layer, and an expansion element that expands the pressure chamber contracted by the contraction element.

DESCRIPTION OF EXEMPLARY EMBODIMENTS

Figure 1:
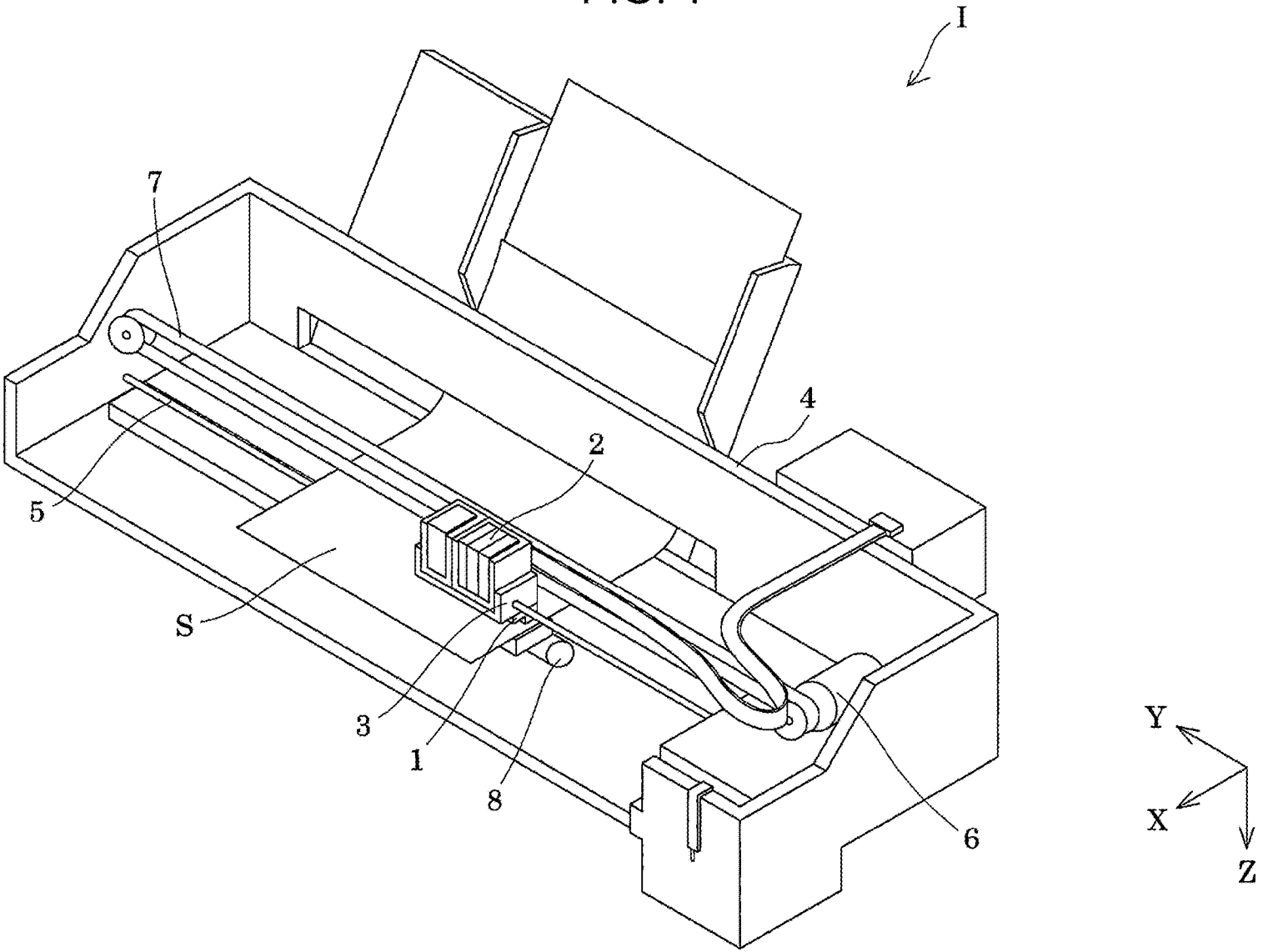
FIG. 1 is a diagram illustrating a schematic configuration of a recording apparatus according to Embodiment 1.

Hereinafter, the present disclosure will be described in detail based on embodiments. Meanwhile, the following description illustrates one aspect of the present disclosure, and can be arbitrarily modified within the scope of the present disclosure. In each drawing, the same reference numerals denote the same members, and the description thereof will be appropriately omitted. Further, in each drawing, X, Y, and Z represent three spatial axes orthogonal to each other. In this specification, directions along these axes are an X-direction, a Y-direction, and a Z-direction. In the following description, a direction of an arrow is a positive (+) direction and a direction opposite to the arrow is a negative (−) direction in each drawing. Further, the Z-direction indicates a vertical direction, and the +Z-direction indicates a vertical downward direction and the −Z-direction indicates a vertical upward direction.

Embodiment 1

FIG. 1 is a schematic diagram illustrating an example of an ink jet recording apparatus which is an example of a liquid ejecting apparatus according to Embodiment 1 of the present disclosure.

As illustrated in FIG. 1, an ink jet recording apparatus I which is an example of a liquid ejecting apparatus according to the present embodiment includes an ink jet recording head 1 (hereinafter, simply referred to as "recording head 1") which ejects ink as an ink droplet, as an example of a liquid ejecting head. The recording head 1 is mounted at a carriage 3 and the carriage 3 is movably provided in the Y-direction which is an axial direction of a carriage shaft 5 attached to an apparatus main body 4. In addition, an ink cartridge 2 constituting a liquid storage unit is detachably provided in the carriage 3.

By a driving force of a driving motor 6 being transmitted to the carriage 3 via a plurality of gears (not illustrated) and a timing belt 7, the carriage 3 at which the recording head 1 is mounted reciprocates along the carriage shaft 5 in the Y-direction. On the other hand, a transport roller 8 is provided in the apparatus main body 4 as a transport unit and a recording sheet S which is a medium to be ejected such as paper on which ink is impacted is transported by the transport roller 8 in the X-direction.

Further, the ink jet recording apparatus I includes a control apparatus 200 which controls the entire ink jet recording apparatus I. The control apparatus 200 will be described in detail below.

In the ink jet recording apparatus I, while the recording sheet S is transported in the +X-direction based on the recording head 1 and the carriage 3 is reciprocated in the Y-direction based on the recording sheet S, by ejecting an ink droplet from the recording head 1, impact of the ink droplet, so-called printing is executed across an approximately entire surface of the recording sheet S.

Figure 2:
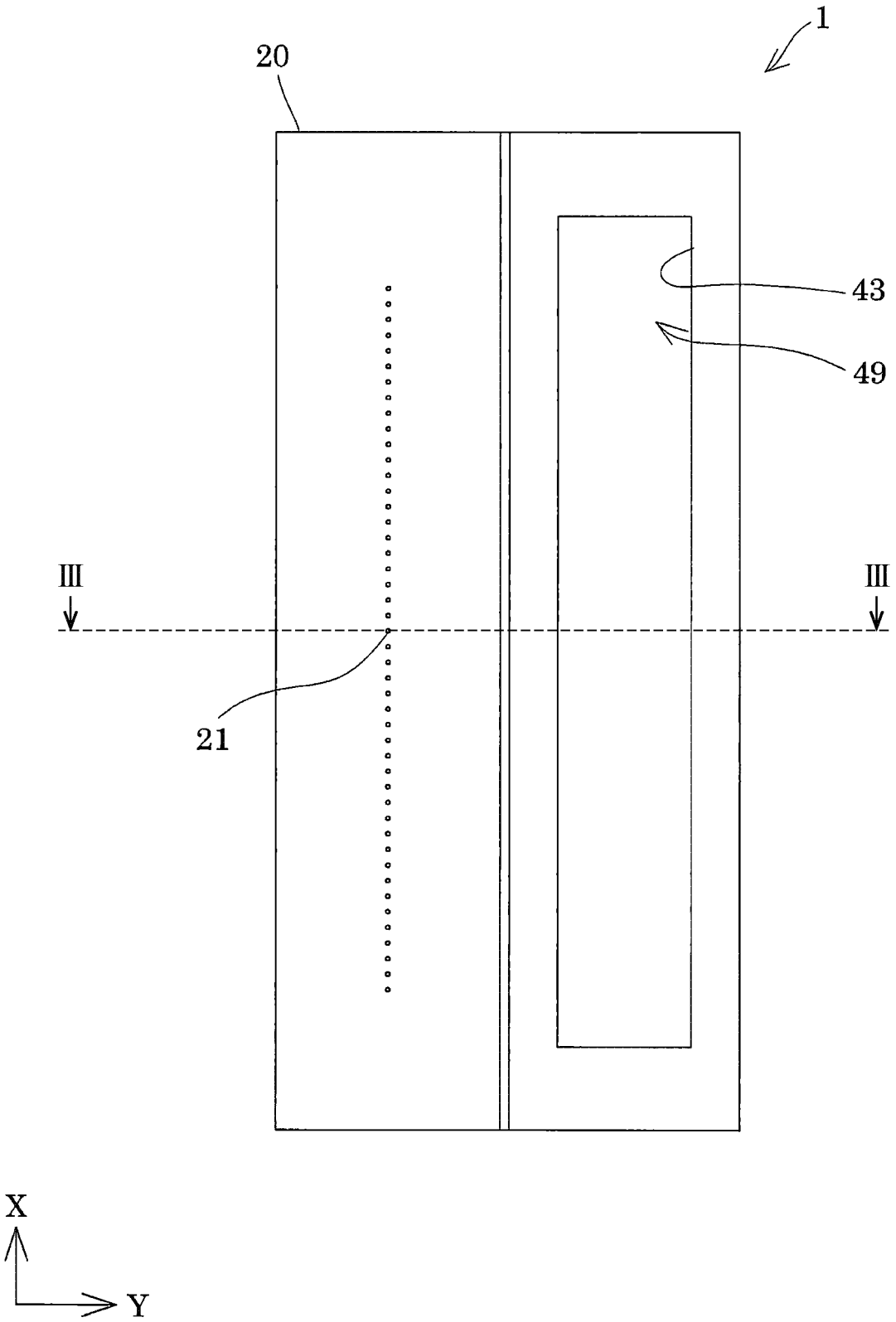
FIG. 2 is a plan view of a recording head according to Embodiment 1.
Figure 3:
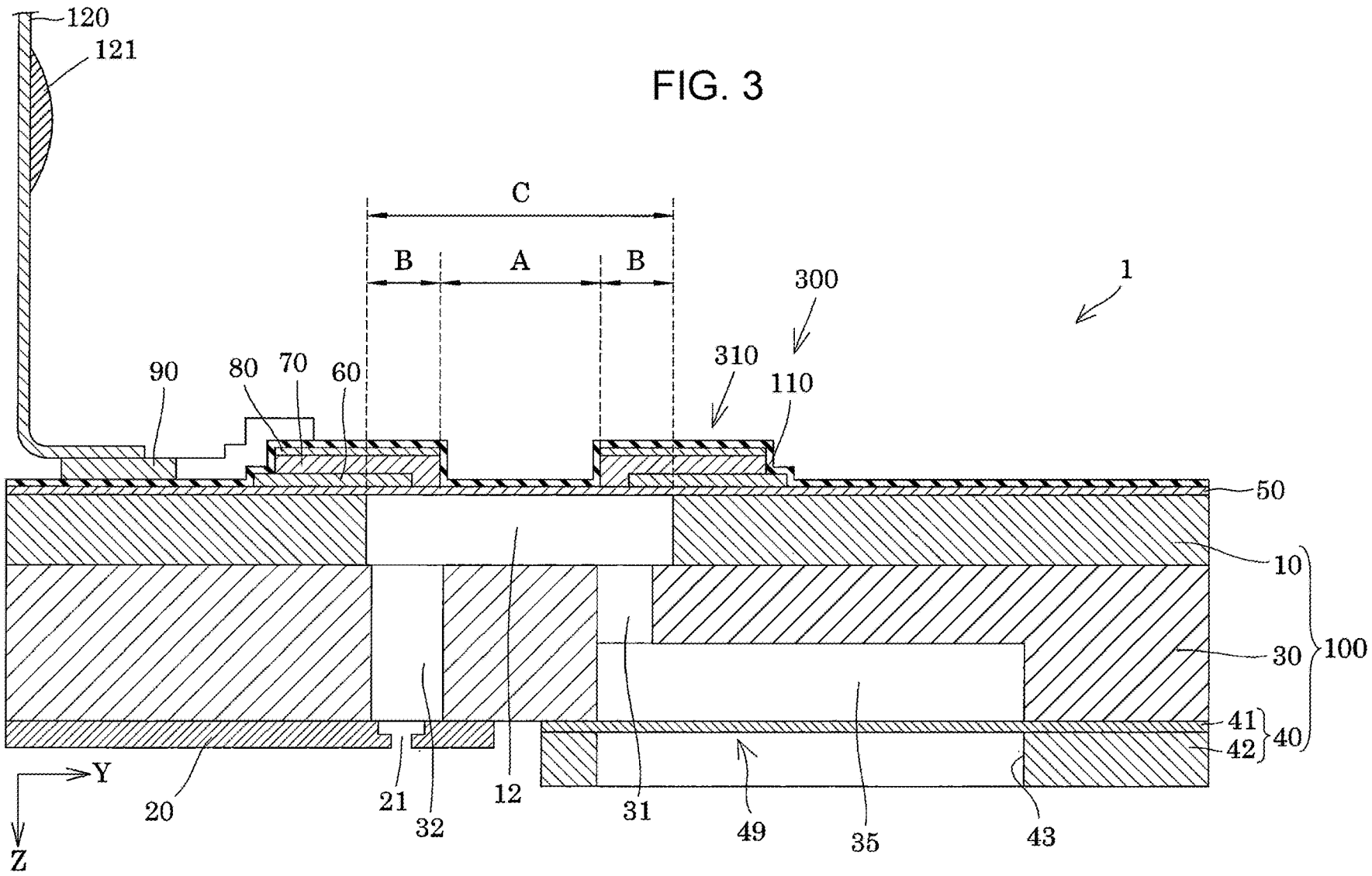
FIG. 3 is a cross-sectional view of the recording head according to Embodiment 1.
Figure 4:
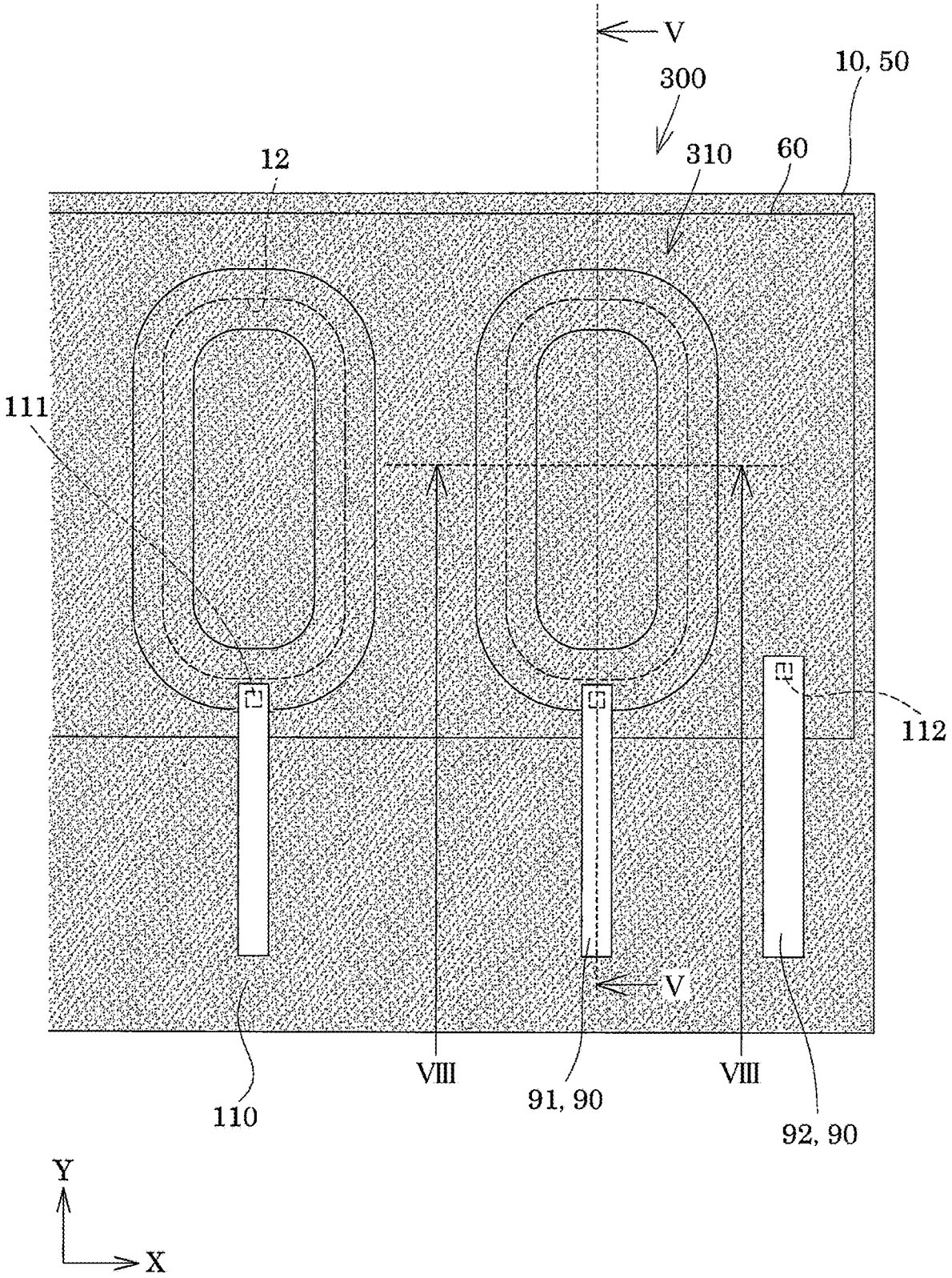
FIG. 4 is a plan view of a piezoelectric actuator according to Embodiment 1.
Figure 5:
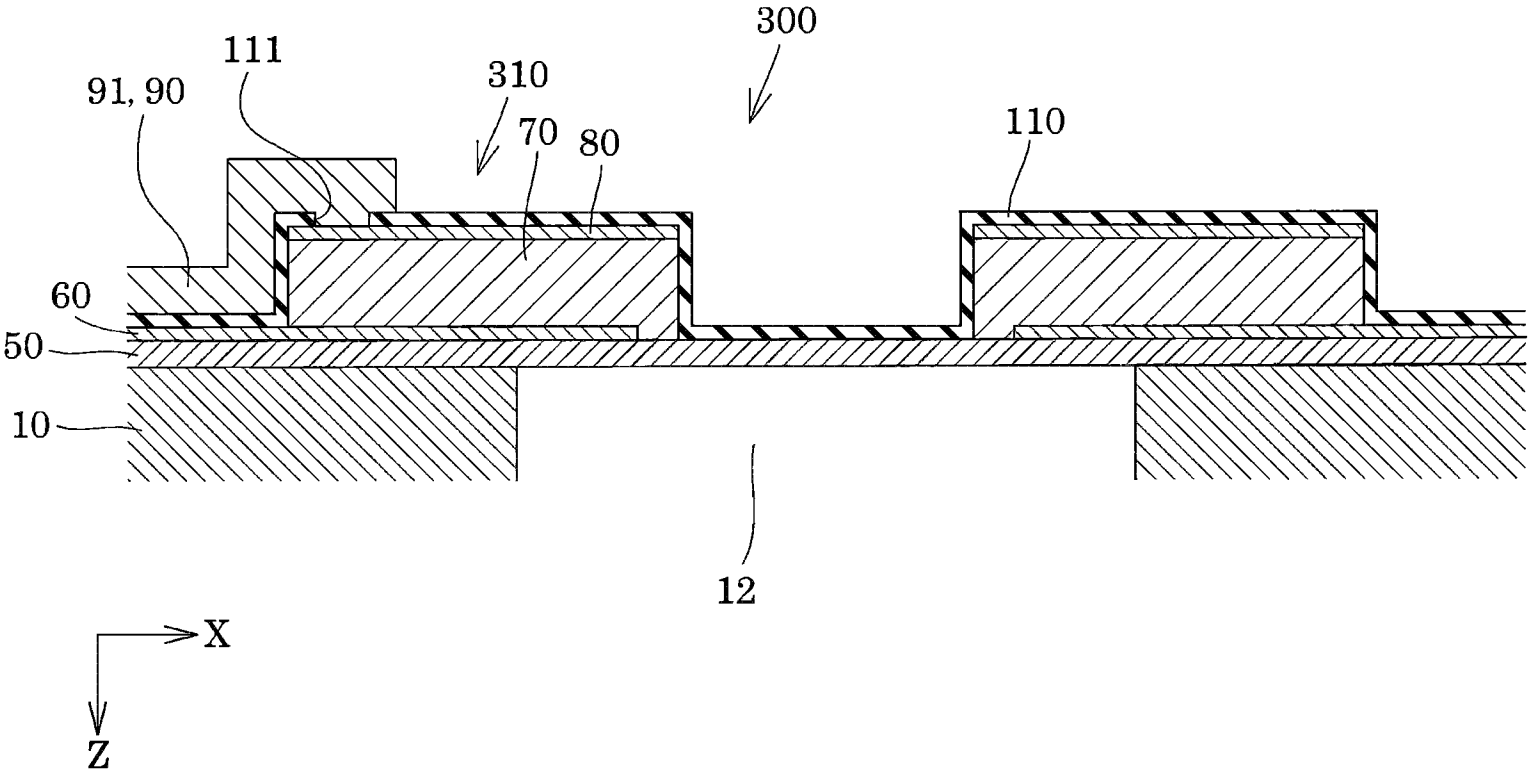
FIG. 5 is an enlarged cross-sectional view of a main portion of the recording head according to Embodiment 1.

Here, the recording head 1 according to the present embodiment mounted on such an ink jet recording apparatus I will be described with reference to FIGS. 2 to 5. FIG. 2 is a plan view illustrating an ink jet recording head which is an example of the liquid ejecting head according to Embodiment 1 according to the disclosure. FIG. 3 is a cross-sectional view taken along the line III-III in FIG. 2. FIG. 4 is an enlarged plan view of a main portion of a piezoelectric actuator. FIG. 5 is a cross-sectional view taken along the line V-V in FIG. 4.

As illustrated, the recording head 1 includes a flow path unit 100 and a piezoelectric actuator 300. The flow path unit 100 according to the present embodiment includes a flow path formation substrate 10, a common liquid chamber substrate 30, a nozzle plate 20, and a compliance substrate 40.

The flow path formation substrate 10 includes a silicon substrate, a glass substrate, an SOI substrate, and various ceramic substrates.

In the flow path formation substrate 10, a plurality of pressure chambers 12 are juxtaposed along the X-direction. The plurality of pressure chambers 12 are arranged on a straight line along the X-direction so that positions in the Y-direction are the same. Of course, the disposition of the pressure chambers 12 is not particularly limited to this, and for example, in the pressure chambers 12 juxtaposed in the X-direction, every other one may be arranged in a position shifted in the Y-direction, so-called staggered disposition.

Further, in the pressure chamber 12 according to the present embodiment, a shape viewed from the Z-direction in plan view, that is, an opening shape in the Z-direction is a so-called rounded rectangular shape in which both end portions in a longitudinal direction are semicircular, based on a rectangular shape in which the Y-direction is the longitudinal direction (also called a track shape). That is, the pressure chamber 12 has an elongated shape in which the Y-direction is the longitudinal direction and the X-direction is a lateral direction when viewed from the Z-direction in plan view. In this manner, by forming the pressure chamber 12 in an elongated shape, when the plurality of pressure chambers 12 are arranged side by side in the lateral direction, a volume of the pressure chamber 12 can be secured and a size can be reduced.

Of course, the shape of the pressure chamber 12 when viewed from the Z-direction in plan view is not particularly limited to this, and an example of the shape may include a square shape, a rectangular shape, a polygonal shape, a parallelogram shape, a fan shape, a circular shape, and an elongated hole shape. Incidentally, the elongated hole shape means an elliptical shape or a shape similar to the elliptical shape, for example, a rounded rectangular shape, an egg shape, an oval shape, or the like.

Further, the common liquid chamber substrate 30 and the nozzle plate 20 are sequentially stacked at a +Z side surface of the flow path formation substrate 10.

The common liquid chamber substrate 30 is a substrate in which a common liquid chamber 35 communicating with each pressure chamber 12 is formed, and is provided at the +Z side surface of the flow path formation substrate 10. The common liquid chamber 35 is provided so as to have a size which is continuous in the X-direction across the plurality of pressure chambers 12. Further, the common liquid chamber 35 is arranged at a position so as to be overlapped with the end portion of the pressure chamber 12 in the Y-direction when viewed from the Z-direction in plan view. Such a common liquid chamber 35 is provided so as to open at a +Z side surface of the common liquid chamber substrate 30.

In addition, a plurality of first flow paths 31 communicating with one end portion of the pressure chamber 12 in the Y-direction are formed in the common liquid chamber substrate 30. The first flow path 31 is independently provided in each of the pressure chambers 12. The first flow path 31 communicates the common liquid chamber 35 and the pressure chamber 12 in the Z-direction, and supplies ink in the common liquid chamber 35 to the pressure chamber 12.

In addition, a plurality of second flow paths 32 which communicate the pressure chambers 12 and nozzles 21 are formed in the common liquid chamber substrate 30. The second flow path 32 is a flow path which couples the pressure chamber 12 and the nozzle 21, and is provided so as to penetrate the common liquid chamber substrate 30 in the Z-direction.

As such a common liquid chamber substrate 30, a silicon substrate, a glass substrate, an SOI substrate, various ceramic substrates, a metal substrate such as a stainless substrate, or the like can be used. The common liquid chamber substrate 30 may be made of a material having approximately an identical coefficient of thermal expansion as the flow path formation substrate 10. In this manner, by using the materials having approximately the identical coefficient of thermal expansion for the flow path formation substrate 10 and the common liquid chamber substrate 30 as described above, it is possible to reduce occurrence of a warpage due to heat by a difference in the coefficient of thermal expansion.

The nozzle plate 20 is provided at a surface, which is opposite to the flow path formation substrate 10, of the common liquid chamber substrate 30, that is, at the +Z side surface.

A plurality of nozzles 21 which eject ink in the +Z-direction are formed in the nozzle plate 20. In the present embodiment, as illustrated in FIG. 2, the plurality of nozzles 21 are arranged on a straight line along the X-direction. That is, the plurality of nozzles 21 are arranged so that positions in the Y-direction are the same. Of course, the disposition of the nozzle 21 is not particularly limited to this, and for example, in the nozzles 21 juxtaposed in the X-direction, every other one may be arranged in a position shifted in the Y-direction, so-called staggered disposition.

As such a nozzle plate 20, a silicon substrate, a glass substrate, an SOI substrate, various ceramic substrates, a metal substrate such as a stainless substrate, or an organic substance such as a polyimide resin can be used.

In addition, the compliance substrate 40 is provided at the +Z side surface, at which the common liquid chamber 35 opens, of the common liquid chamber substrate 30. The compliance substrate 40 seals a +Z side opening of the common liquid chamber 35. In the present embodiment, such a compliance substrate 40 includes a sealing film 41 made of a flexible thin film and a fixed substrate 42 made of a hard material such as metal. A region, facing the common liquid chamber 35, in the fixed substrate 42 is an opening portion 43 which is completely removed in a thickness direction. Therefore, one surface of the common liquid chamber 35 serves as a compliance portion 49 which is a flexible portion sealed only with the sealing film 41 having flexibility. In this manner, by providing the compliance portion 49 at a part of a wall surface of the common liquid chamber 35 as described above, pressure fluctuation of the ink in the common liquid chamber 35 can be absorbed by deformation of the compliance portion 49.

In the flow path unit 100 having such a configuration, an ink flow path from the common liquid chamber 35 to the nozzle 21 via the first flow path 31, the pressure chamber 12, and the second flow path 32 is formed. Although not particularly illustrated, the common liquid chamber 35 is configured to be supplied with ink from an external ink supply unit. The ink supplied from the external ink supply unit is supplied to the common liquid chamber 35. The ink is supplied from the common liquid chamber 35 to each pressure chamber 12 via each first flow path 31. The ink in the pressure chamber 12 is ejected from the nozzle 21 via the second flow path 32 by the piezoelectric actuator 300 to be described below.

On the other hand, a vibration plate 50 is formed at the −Z side surface of the flow path formation substrate 10 opposite to the common liquid chamber substrate 30. The vibration plate 50 is a flexible member including a single layer or a plurality of layers selected from a silicon layer, a silicon dioxide layer, a silicon nitride layer, a zirconium oxide layer, and the like.

Further, a first electrode 60, a piezoelectric layer 70, and a second electrode 80 are sequentially stacked in the −Z-direction over the vibration plate 50 by a film formation and lithography method. The piezoelectric actuator 300 according to the present embodiment is configured to include the vibration plate 50, the first electrode 60, the piezoelectric layer 70, and the second electrode 80. In the present embodiment, the piezoelectric actuator 300 is an energy generation element which causes a pressure change in ink inside the pressure chamber 12. Here, the piezoelectric actuator 300 is also referred to as a piezoelectric element, and is a portion including the vibration plate 50, the first electrode 60, the piezoelectric layer 70, and the second electrode 80.

Further, in the piezoelectric actuator 300, a portion in which piezoelectric strain is generated in the piezoelectric layer 70 when a voltage is applied between the first electrode 60 and the second electrode 80 is referred to as an active portion 310. In the present embodiment, as will be described below in detail, the active portion 310 is formed for each pressure chamber 12. That is, a plurality of active portions 310 formed in the piezoelectric actuator 300. In general, one electrode of the active portion 310 is used as a common electrode common to the plurality of active portions 310, and the other electrode is configured as an individual electrode which is independent for each active portion 310. In the present embodiment, the first electrode 60 is the common electrode and the second electrode 80 is the individual electrode, but this may be reversed. In the example described above, the vibration plate 50 and the first electrode 60 are operated as a vibration plate, but the example is not limited thereto and only the first electrode 60 may be operated as the vibration plate without being provided with the vibration plate 50. In addition, the piezoelectric actuator 300 itself may practically serve also as the vibration plate.

Here, in the present embodiment, a region, facing the pressure chamber 12, in the vibration plate 50 is referred to as a movable region C. Further, in the movable region C, a region which is inside a wall surface which is an end portion of the pressure chamber 12, and does not include a central portion of the pressure chamber 12 when viewed from the Z-direction in plan view is referred to as an edge portion B. The piezoelectric actuator 300 is provided at the edge portion B. Further, a region other than the edge portion B in the movable region C is referred to as a central portion A. The active portion 310 of the piezoelectric actuator 300 is not provided in the central portion A.

For such a vibration plate 50, the active portion 310 is provided at the edge portion B in the movable region C (see FIG. 3) of the vibration plate 50. Further, in the present embodiment, the active portion 310 extends outside the edge portion B, that is, outside the pressure chamber 12. The active portion 310 is not provided in the central portion A. That is, the active portion 310 of the piezoelectric actuator 300 is provided continuously over the outer side of the pressure chamber 12 and the edge portion B and across a boundary portion of a wall surface of the pressure chamber 12.

As illustrated in FIG. 4, a shape of the active portion 310 in plan view is approximately the same as the shape of the pressure chamber 12, and is an annular rounded rectangular shape having the Y-direction as the longitudinal direction.

Specifically, the first electrode 60 is continuously provided across the plurality of pressure chambers 12 and constitutes the common electrode common to the plurality of active portions 310 of the piezoelectric actuator 300. The first electrode 60 is continuously provided so that a width in the Y-direction is wider than a length of the pressure chamber 12 in the Y-direction and the first electrode 60 is across the plurality of pressure chambers 12 juxtaposed in the X-direction. In addition, the first electrode 60 is not provided in the central portion A of the vibration plate 50, and an end portion at the central portion A side is covered with the piezoelectric layer 70. Of course, the first electrode 60 may be provided in the central portion A of the vibration plate 50.

The piezoelectric layer 70 is continuously provided across the X-direction so as to have a predetermined width in the Y-direction. A width of the piezoelectric layer 70 in the Y-direction is wider than the length of the pressure chamber 12 in the Y-direction. Therefore, in the Y-direction of the pressure chamber 12, the piezoelectric layer 70 is provided up to the outside of the pressure chamber 12. In the present embodiment, the piezoelectric layer 70 is continuously provided over the plurality of pressure chambers 12, but the present embodiment is not particularly limited to this, and the piezoelectric layer 70 may be provided separately across a wall surface of the adjacent pressure chamber 12, for each pressure chamber 12.

The piezoelectric layer 70 is made of an oxide piezoelectric material having a polarization structure formed at the first electrode 60, and may be made of, for example, a perovskite type oxide represented by the general formula $ABO_3$. As the piezoelectric layer 70, a lead-based piezoelectric material containing lead, a lead-free piezoelectric material containing no lead, or the like can be used.

In the piezoelectric layer 70, a direction of polarization or a dipole remaining inside the piezoelectric layer 70 when no potential is applied (hereinafter, collectively referred to as a polarization direction) may be from the first electrode 60 toward the second electrode 80 in the Z-direction, or may be from the second electrode 80 toward the first electrode 60 in the +Z-direction. In the present embodiment, the polarization direction of the piezoelectric layer 70 is a direction from the first electrode 60 to the second electrode 80, that is, the −Z-direction.

The second electrode 80 is divided for each pressure chamber 12 and constitutes an individual electrode independent for each active portion 310 of the piezoelectric actuator 300. The second electrode 80 is formed in an annular shape when viewed from the Z-direction in plan view. That is, in the same manner as the pressure chamber 12, the second electrode 80 has a rounded rectangular outer peripheral shape having the Y-direction as a major axis, and an opening portion having a shape approximately similar to the outer peripheral shape is formed in a central portion of the second electrode 80 so as to be formed in an annular shape. An end portion of the second electrode 80 defines a range of the active portion 310. That is, the second electrode 80 is provided at the edge portion B of the movable region C (see FIG. 3) of the vibration plate 50 and outside the edge portion B, that is, outside the pressure chamber 12, and the second electrode 80 is not provided in the central portion A. Such a second electrode 80 may have a film having a thickness equal to or less than 100 nm. In this manner, by providing the second electrode 80 with the thickness equal to or less than 100 nm, it is possible to suppress the second electrode 80 from inhibiting deformation of the active portion 310 and to suppress a displacement amount of the active portion 310 from decreasing. The second electrode 80 may be made of at least one material selected from a group consisting of platinum (Pt), iridium (Ir), and gold (Au). In this manner, by using at least one material selected from the group consisting of platinum (Pt), iridium (Ir), and gold (Au) for the second electrode 80, an electric resistance value of the second electrode 80 can be reduced and a voltage drop can be suppressed.

As illustrated in FIG. 5, the piezoelectric actuator 300 is covered with a protective film 110. As the protective film 110, an insulating material having moisture resistance can be used. In the present embodiment, the protective film 110 is continuously provided over the first electrode 60 so as to cover a side surface of the piezoelectric layer 70, a side surface and an upper surface of the second electrode 80, and the central portion A of the vibration plate 50. Although the protective film 110 covers the central portion A of the vibration plate 50 in the present embodiment, the present embodiment is not limited to this, and the protective film 110 may be provided so as not to partially or entirely cover the central portion A of the vibration plate 50. By providing the protective film 110 so as not to cover a part or the whole of the central portion A of the vibration plate 50 in this manner, it is possible to suppress the protective film 110 from inhibiting displacement of the vibration plate 50 and to suppress a displacement amount from decreasing.

In this manner, by covering the side surface of the piezoelectric layer 70 with the protective film 110, it is possible to suppress a current from leaking between the first electrode 60 and the second electrode 80, and to suppress damage such as burning due to a leakage current of the piezoelectric actuator 300. Further, by providing the protective film 110, it is possible to suppress the first electrode 60 and the second electrode 80 from being short-circuited by a lead electrode 90, which will be described below in detail, which is a lead wiring.

As a material of such a protective film 110, a material having moisture resistance may be used, and an inorganic insulating material, an organic insulating material, or the like can be used.

As an inorganic insulating material which can be used as the protective film 110, at least one type selected from, for example, silicon oxide ($SiO_x$), zirconium oxide ($ZrO_x$), tantalum oxide ($TaO_x$), aluminum oxide ($AlO_x$), and titanium oxide ($TiO_x$) can be used. As the inorganic insulating material of the protective film 110, aluminum oxide ($AlO_x$) which is an inorganic amorphous material, for example, alumina ($Al_2O_3$) may be used. The protective film 110 made of an inorganic insulating material can be formed by, for example, an MOD method, a sol-gel method, a sputtering method, a CVD method, or the like.

In addition, as the organic insulating material which can be used as the protective film 110, for example, at least one selected from an epoxy resin, a polyimide resin, a silicon resin, and a fluorine resin can be used. The protective film 110 made of an organic insulating material can be formed by, for example, a spin coating method, a spray method, or the like.

The lead electrode 90, which is a lead wiring drawn from each electrode of the piezoelectric actuator 300, is provided over the protective film 110. The lead electrode 90 includes an individual lead electrode 91 extracted from the second electrode 80 and a common lead electrode 92 extracted from the first electrode 60. The lead electrode 90 may be made of a material containing at least one selected from the group consisting of Pt, Ir, Au, ITO, Cu, Al, Al—Cu, and Al—Nd. Further, the lead electrode 90 may have an adhesion layer which improves adhesion to the protective film 110.

Here, the individual lead electrode 91 is coupled to the second electrode 80 via a contact hole 111 provided in the protective film 110 at one end portion in the Y-direction. The other end portion of the individual lead electrode 91 is extended along the Y-direction to a region, in which the first electrode 60 is not formed, at the flow path formation substrate 10.

A wiring substrate 121 at which the drive circuit 120 is mounted is electrically coupled to the individual lead electrode 91. The drive circuit 120 includes a circuit substrate, a semiconductor integrated circuit (IC), or the like. Further, the wiring substrate 121 is a COF substrate which is a kind of a flexible wiring substrate. A drive signal from the drive circuit 120 is supplied to the second electrode 80 via the individual lead electrode 91.

Further, one end of the common lead electrode 92 is coupled to the first electrode 60 via a contact hole 112 provided in the protective film 110 at an end portion in the Y-direction. The other end portion of the common lead electrode 92 is extended along the Y-direction to a region, in which the first electrode 60 is not formed, at the flow path formation substrate 10.

Here, one end of the common lead electrode 92 is coupled to the first electrode 60 via the contact hole 112 provided in the protective film 110 at an end portion in the Y-direction.

In this manner, in the recording head 1, after ink is filled from the common liquid chamber 35 to the nozzle 21, pressure inside the pressure chamber 12 increases and the ink is ejected from the nozzle 21 by applying a voltage between the first electrode 60 and the second electrode 80 respectively corresponding to the pressure chamber 12 according to a drive signal from the drive circuit 120, and bending and deforming the vibration plate 50 and the piezoelectric actuator 300.

Figure 6:
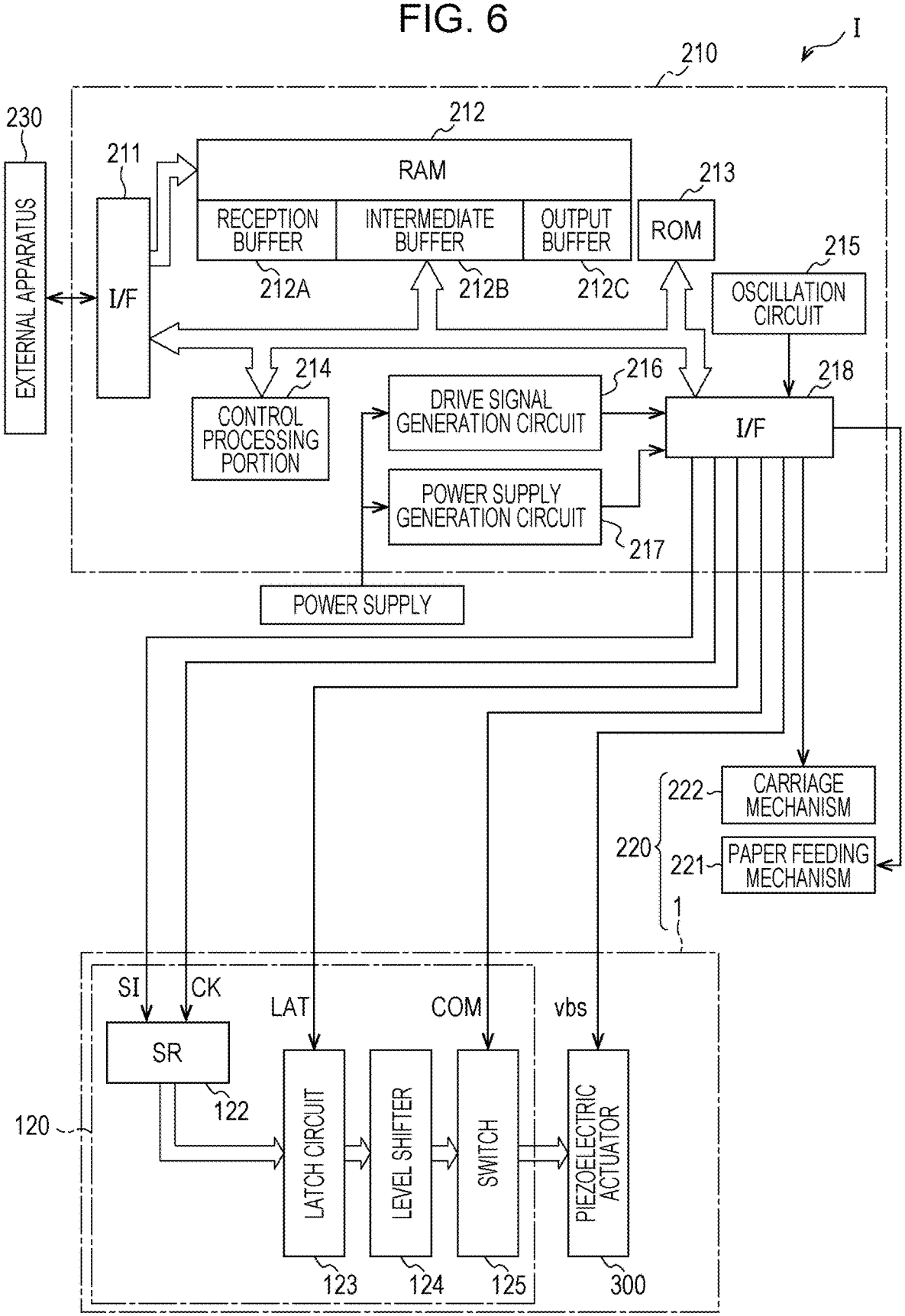
FIG. 6 is a block diagram illustrating an electrical configuration of the recording apparatus according to Embodiment 1.

Further, as illustrated in FIG. 1, the ink jet recording apparatus I includes the control apparatus 200. Here, an electrical configuration according to the present embodiment will be described with reference to FIG. 6. FIG. 6 is a block diagram illustrating an electrical configuration of the ink jet recording apparatus I according to Embodiment 1 of the present disclosure.

As illustrated in FIG. 6, the ink jet recording apparatus I includes a printer controller 210 and a print engine 220.

The printer controller 210 is an element which controls the overall ink jet recording apparatus I and is provided in the control apparatus 200 provided in the ink jet recording apparatus I in the present embodiment.

The printer controller 210 includes an external interface 211 (hereinafter, referred to as the external I/F 211), a RAM 212, a ROM 213, a control processing portion 214, an oscillation circuit 215 which generates a clock signal, a drive signal generation circuit 216, a power supply generation circuit 217, and an internal interface 218 (hereinafter, referred to as the internal I/F 218).

The external I/F 211 receives print data including, for example, a character code, a graphic function, image data, and the like from an external apparatus 230 such as a host computer. Further, a busy signal (BUSY) or an acknowledge signal (ACK) is output to the external apparatus 230 through the external I/F 211.

The RAM 212 temporarily stores various types of data and functions as a reception buffer 212A, an intermediate buffer 212B, an output buffer 212C, and a work memory (not illustrated). The reception buffer 212A temporarily stores the print data received by the external I/F 211, the intermediate buffer 212B stores intermediate code data converted by the control processing portion 214, and the output buffer 212C stores dot pattern data. The dot pattern data is configured with print data obtained by decoding (translating) gradation data.

Further, the ROM 213 stores font data, a graphic function, and the like in addition to a control program (a control routine) for performing a process on various types of data.

The control processing portion 214 is configured to include a CPU and the like. The control processing portion 214 reads the print data in the reception buffer 212A and stores the intermediate code data obtained by converting the print data in the intermediate buffer 212B. Further, the intermediate code data read from the intermediate buffer 212B is analyzed, and the intermediate code data is expanded into dot pattern data by referring to the font data and the graphic function stored in the ROM 213. The control processing portion 214 stores the developed dot pattern data in the output buffer 212C after executing a necessary decoration process.

When dot pattern data for one line is obtained in the recording head 1, the dot pattern data for one line is output to the recording head 1 through the internal I/F 218. Further, when the dot pattern data for one line is output from the output buffer 212C, the developed intermediate code data is deleted from the intermediate buffer 212B, and the development process is performed on the next intermediate code data. That is, the internal I/F 218 transmits the dot pattern data (also referred to as bitmap data) or the like developed based on a drive signal or print data, to the print engine 220.

The drive signal generation circuit 216 generates a common drive signal COM to be supplied to the recording head 1 based on power supplied from the outside.

Further, the power supply generation circuit 217 generates a bias potential vbs, which will be described in detail below, to be supplied to the first electrode 60 which is a common electrode of the piezoelectric actuator 300 based on the power supplied from the outside.

The print engine 220 is configured to include the recording head 1, a paper feeding mechanism 221, and a carriage mechanism 222. The paper feeding mechanism 221 is configured to include the transport roller 8 and a motor (not illustrated) or the like which drives the transport roller 8, and sequentially feeds the recording sheet S in conjunction with a recording operation of the recording head 1. That is, the paper feeding mechanism 221 relatively moves the recording sheet S in the X-direction. The carriage mechanism 222 includes the carriage 3, and a driving motor 6 or a timing belt 7 which moves the carriage 3 along the carriage shaft 5 in the Y-direction.

The recording head 1 includes a shift register 122, a latch circuit 123, a level shifter 124, a drive circuit 120 having a switch 125, and the piezoelectric actuator 300. Although not particularly illustrated, the shift register 122, the latch circuit 123, the level shifter 124, the switch 125, and the piezoelectric actuator 300 are respectively provided as a shift register element, a latch element, a level shifter element, a switch element, and a piezoelectric actuator 300 provided for each nozzle 21 of the recording head 1. The shift register 122, the latch circuit 123, the level shifter 124, the switch 125, and the piezoelectric actuator 300 are electrically coupled in this order. The shift register 122, the latch circuit 123, the level shifter 124, and the switch 125 generate an application pulse to be actually applied from the common drive signal COM generated by the drive signal generation circuit 216 to the piezoelectric actuator 300.

In the present embodiment, the printer controller 210 and the drive circuit 120 correspond to a drive unit in the scope of the aspects.

Figure 7:
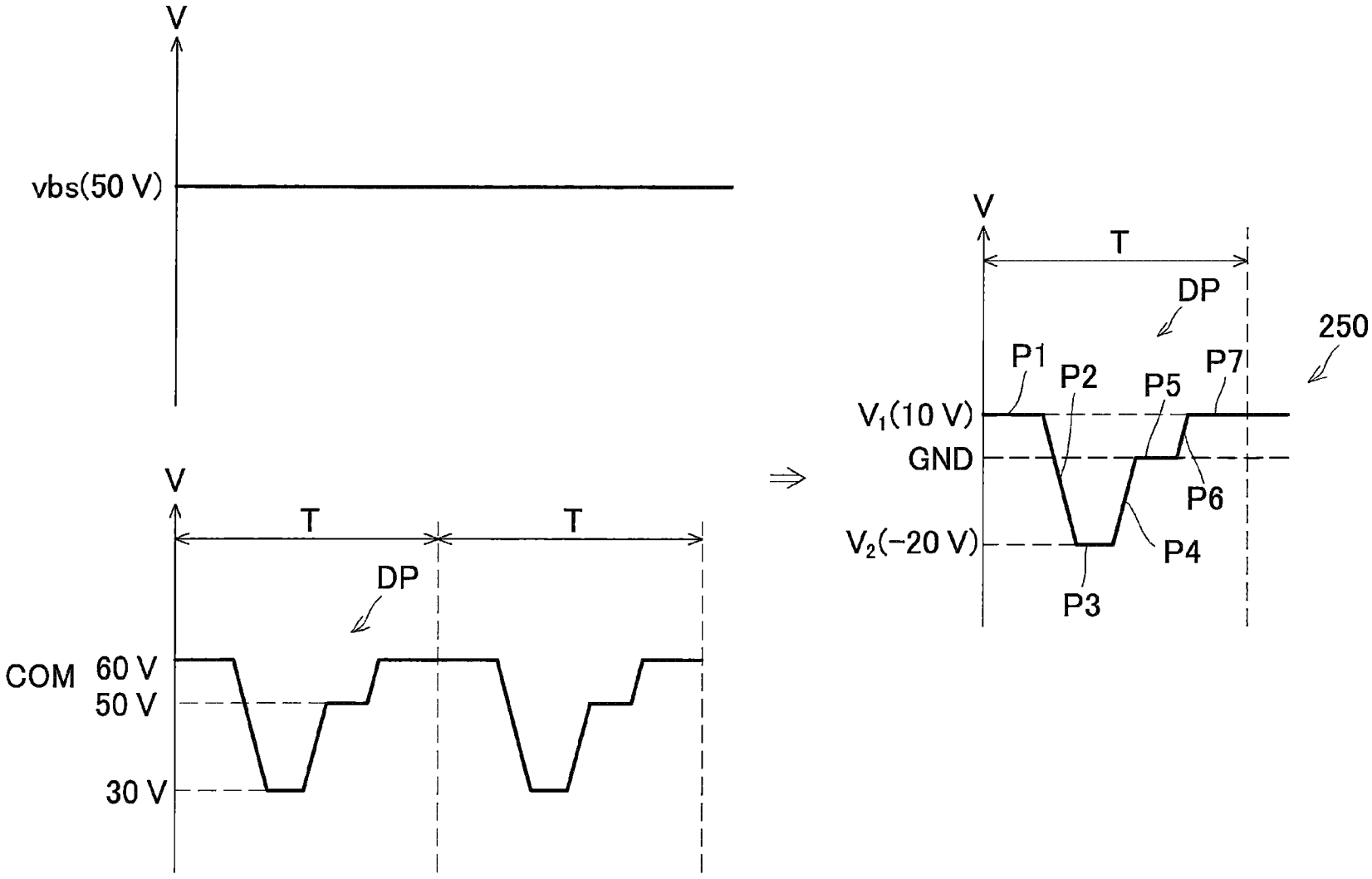
FIG. 7 is a drive waveform illustrating a drive signal according to Embodiment 1.
Figure 8:
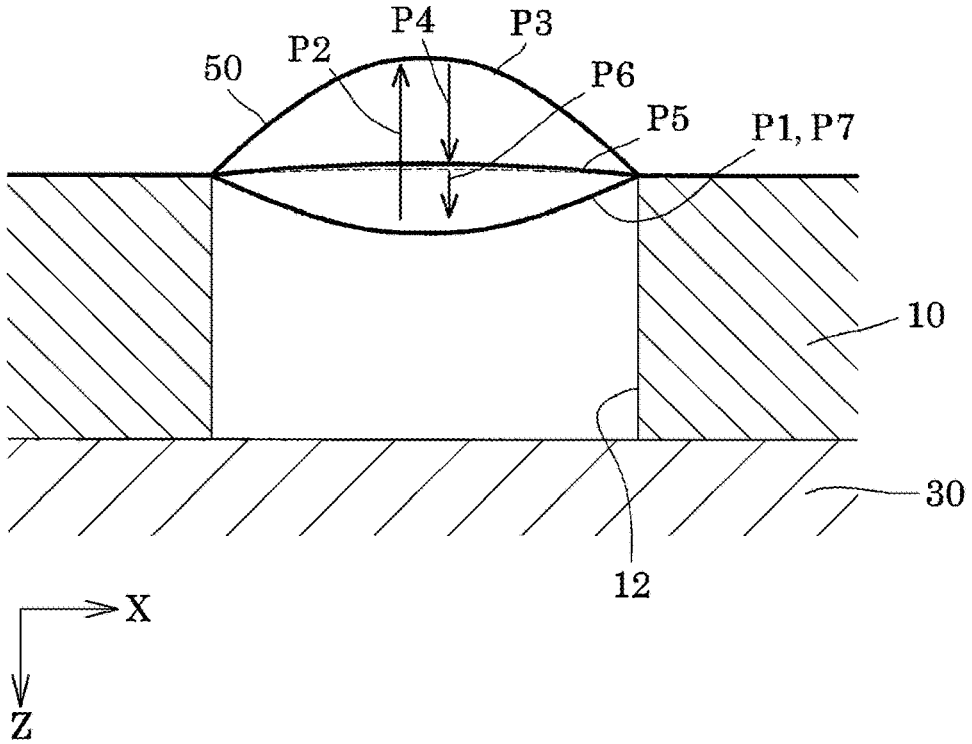
FIG. 8 is a cross-sectional view schematically illustrating a deformed state of a vibration plate according to Embodiment 1.

Here, a drive waveform indicating the common drive signal generated by the drive signal generation circuit 216 will be described. FIG. 7 is a drive waveform illustrating a bias potential, a common drive signal, and a drive signal. FIG. 8 is a diagram illustrating a deformed state of a vibration plate due to a drive signal, and is a diagram schematically illustrating a cross-section taken along the line VIII-VIII in FIG. 4.

As illustrated in FIG. 7, the common drive signal COM according to the present embodiment is repeatedly generated by the drive signal generation circuit 216 for each unit cycle T defined by a clock signal oscillated by the oscillation circuit 215. The unit cycle T is also called an ejection cycle T or a recording cycle T, and corresponds to one pixel of an image or the like printed on the recording sheet S. In the present embodiment, the common drive signal COM is a signal having an ejection pulse DP which drives the piezoelectric actuator 300 so that an ink droplet is ejected from the nozzles 21 within one recording cycle T, and is repeatedly generated at each recording cycle T.

When a dot pattern for one line (for one raster) is formed in a recording area of the recording sheet S during printing, the ejection pulse DP of the common drive signal COM is selectively applied to the piezoelectric actuator 300 corresponding to each nozzle 21. That is, an application pulse is generated from a head control signal and the common drive signal COM for each piezoelectric actuator 300 corresponding to each nozzle 21, and the application pulse is supplied to the piezoelectric actuator 300.

Such an application pulse is supplied to the second electrode 80 which is an individual electrode for each active portion 310 of the piezoelectric actuator 300. Further, the bias potential vbs is supplied to the first electrode 60, which is a common electrode of the plurality of active portions 310 of the piezoelectric actuator 300. Therefore, a potential to be applied to the second electrode 80, which is an individual electrode of the piezoelectric actuator 300 by the application pulse, is represented with the bias potential vbs to be applied to the first electrode 60 as a reference potential.

In the example illustrated in FIG. 7, by supplying the bias potential vbs to the first electrode 60, the first electrode 60 is maintained at a potential of substantially 30 V.

The ejection pulse DP represented by a drive waveform having a minimum potential of substantially 30 V and a maximum potential of substantially 60 V is supplied to the second electrode 80.

A potential difference of the second electrode 80 based on a potential of the first electrode 60, that is, (a potential of the second electrode 80)−(the potential of the first electrode 60) becomes a drive voltage V for the piezoelectric layer 70. A profile of the drive voltage V with time is a drive signal 250 to be supplied to the piezoelectric actuator 300.

Here, the drive signal 250 to be supplied to the piezoelectric actuator 300 includes a first contraction maintaining element P1, an expansion element P2, an expansion maintaining element P3, a first contraction element P4, a reference volume maintaining element P5, a second contraction element P6, and a second contraction maintaining element P7.

The first contraction maintaining element P1 maintains the volume of the pressure chamber 12 in a state of being contracted from a reference volume by applying a first potential $V_1$ (here, 10 V) to the piezoelectric actuator 300. In the present embodiment, the first contraction maintaining element P1 corresponds to a contraction element described in the aspects. That is, a contraction element which contracts the pressure chamber 12 below the reference volume also includes an element which maintains the pressure chamber 12 in a state of being contracted below the reference volume.

Figure 9:
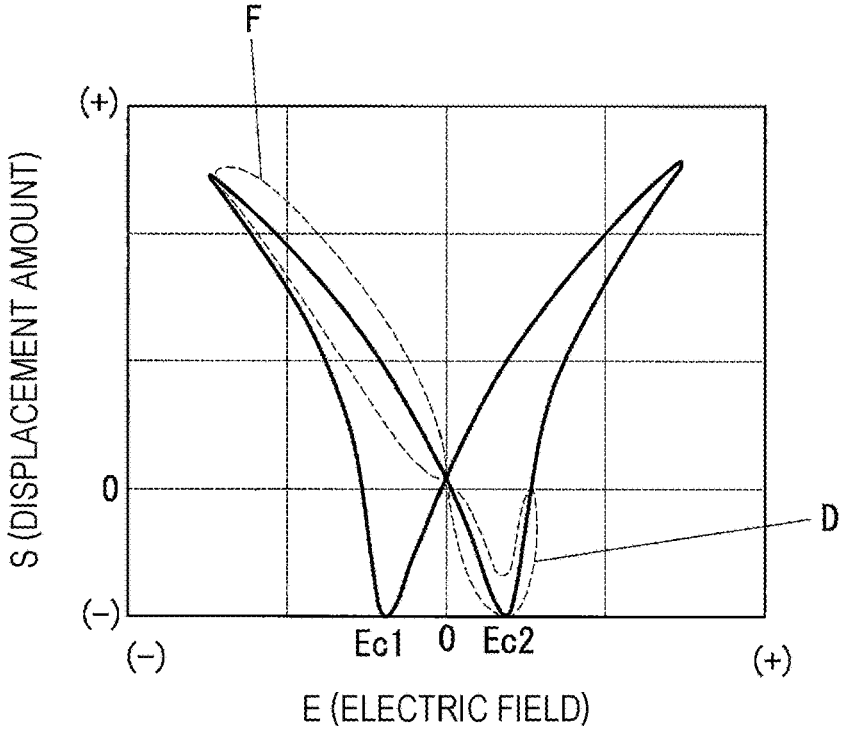
FIG. 9 is a graph illustrating a relationship between a displacement amount of a piezoelectric layer and an electric field according to Embodiment 1.

Specifically, when a positive (+) potential is applied to the second electrode 80 in the same manner as the first contraction maintaining element P1, an electric field from the second electrode 80 toward the first electrode 60 in the +Z-direction is applied to the piezoelectric layer 70. Since the piezoelectric layer 70 has a polarization direction from the first electrode 60 to the second electrode 80 in the −Z-direction, the electric field in the +Z-direction opposite to the −Z-direction, which is the polarization direction, is applied to the piezoelectric layer 70. Therefore, the piezoelectric layer 70 is contracted in the −Z-direction, which is the electric field direction, and is extended in an in-plane direction including the X-direction and the Y-direction, which are directions orthogonal to a polarization direction. That is, as illustrated in FIG. 9, by applying an electric field E so as to use the region D in the butterfly curve illustrating a relationship of S (an electric field induced strain (a displacement amount)) between E (an electric field) of the piezoelectric layer 70, the piezoelectric layer 70 can be contracted in the −Z-direction, which is an electric field direction, and can be expanded in an in-plane direction including the X-direction and the Y-direction, which are directions orthogonal to the polarization direction.

Since the active portion 310 of the piezoelectric actuator 300 is provided from the outside of the pressure chamber 12 across the edge portion B, the piezoelectric layer 70 is extended in an in-plane direction including the X-direction and the Y-direction, so that the piezoelectric actuator 300 deflects and is deformed toward the pressure chamber 12 side, that is, in the +Z-direction. That is, the state in which the piezoelectric actuator 300 is deformed in a direction of the volume of the pressure chamber 12 being contracted is maintained by the first contraction maintaining element P1. As a result, the piezoelectric actuator 300 is maintained in a state of being deformed in the +Z-direction, which is the pressure chamber 12 side.

Incidentally, deformation of the piezoelectric actuator 300 in the +Z-direction which is the pressure chamber 12 side includes that a surface, on the +Z side which is the pressure chamber 12 side, of the piezoelectric actuator 300 is deformed in a state of protruding in a convex shape and that a surface, on the −Z side which is the side opposite to the 12 side, of the piezoelectric actuator 300 is in a state of protruding in a convex shape. That is, for example, when the initial deflection of the piezoelectric actuator 300 is deformed so as to protrude in a convex shape toward the −Z side opposite to the pressure chamber 12, the piezoelectric actuator 300 is deformed by the first contraction maintaining element P1 so as to protrude in a convex shape to the −Z side, and is deformed so that a protrusion amount to the −Z side is reduced. A posture of the piezoelectric actuator 300 by the first contraction maintaining element P1 is determined by a characteristic of a stacked film including the vibration plate 50 which determines the initial deflection of the piezoelectric actuator 300, that is, internal stress of each film or a position of a neutral line, and a magnitude of the first potential $V_1$ by the first contraction maintaining element P1 with respect to a displacement characteristic of the piezoelectric layer 70, that is, a displacement amount.

In the present embodiment, as illustrated by the dotted line in FIG. 8, in the initial deflection when no potential is applied to the piezoelectric actuator 300, the piezoelectric actuator 300 has a convex shape on the −Z side, which is opposite to the pressure chamber 12. In addition, the piezoelectric actuator 300 is deformed in a convex shape toward the pressure chamber 12 side when the first potential $V_1$ of the first contraction maintaining element P1 is applied.

In this manner, by supplying the first contraction maintaining element P1, the piezoelectric actuator 300 can be maintained in a state of being reliably deformed in the +Z-direction, which is the pressure chamber 12 side, regardless of a posture when no potential is applied to the piezoelectric actuator 300, that is, whatever posture the initial deflection is. That is, even when the initial deflection of the piezoelectric actuator 300 is in a state in which the piezoelectric actuator 300 deformed in a convex shape toward the pressure chamber 12 side and even when the piezoelectric actuator 300 is also deformed in a convex shape toward a side opposite to the pressure chamber 12, the first contraction maintaining element P1 is supplied, so that the piezoelectric actuator 300 can be deformed toward the pressure chamber 12 side, and particularly, can be deformed so as to be convex toward the pressure chamber 12 side. Incidentally, the piezoelectric actuator 300 may have an initial deflection having a convex shape toward the +Z side, which is the pressure chamber 12 side. Meanwhile, in the piezoelectric actuator 300, when the initial deflection is convex toward the −Z side, which is the side opposite to the pressure chamber 12, a member having compressive stress can be introduced as a member forming the vibration plate 50. By making the internal stress of the vibration plate 50 the compressive stress in this manner, when tensile stress is applied to the vibration plate 50 by the expansion element P2, the expansion maintaining element P3, the first contraction element P4, and the like, it is possible to suppress damage of the vibration plate 50.

When the electric field applied to the piezoelectric layer 70 made of a dielectric material is changed, the piezoelectric layer 70 has a curve having a hysteresis characteristic in which positive and negative polarities are inverted at a coercive electric field (a coercive electric field Ec1 on the negative electrode side and a coercive electric field Ec2 on the positive electrode side), that is, a so-called hysteresis curve is drawn. Therefore, the electric field applied to the piezoelectric layer 70 by the first contraction maintaining element P1 may be larger than the coercive electric field Ec1 on the negative electrode side and smaller than the coercive electric field Ec2 on the positive electrode side. That is, an absolute value of the first potential $V_1$ which is a potential applied to the piezoelectric actuator 300 by the first contraction maintaining element P1 may be larger than zero (0) and equal to or less than an absolute value of a potential which becomes the coercive electric fields (Ec1 and Ec2) of the piezoelectric layer 70, that is, the so-called a coercive potential Vc (a sum of +Vc and −Vc is referred to as Vc) ($0<|V_1|\leq|Vc|$). In the present embodiment, the first potential $V_1$ is a positive (+) potential, so $0<V_1\leq+Vc$ may be satisfied. In this manner, the absolute value of the first potential $V_1$ is set to a value which does not exceed an absolute value of the coercive potential Vc of the piezoelectric layer 70, so that the first contraction maintaining element P1 can contract the piezoelectric layer 70 in the −Z-direction, which is a polarization direction, without reversing polarization of the piezoelectric layer 70 by the first contraction maintaining element P1.

The expansion element P2 applies the first potential $V_1$ (10 V) to a second potential $V_2$ (here, −20 V), to the piezoelectric actuator 300 so as to expand the volume of the pressure chamber 12 from the first contraction maintaining element P1. In the present embodiment, the expansion element P2 corresponds to an expansion element described in the aspects.

Specifically, when a negative (−) potential is applied to the second electrode 80 in the same manner as the expansion element P2, an electric field from the first electrode 60 to the second electrode 80 in the −Z-direction is applied to the piezoelectric layer 70. Since the piezoelectric layer 70 has a polarization direction in the −Z-direction, an electric field direction and a polarization direction coincide with each other. As a result, the piezoelectric layer 70 is expanded in the −Z-direction which is the electric field direction and is contracted in the in-plane direction including the X-direction and the Y-direction which are directions orthogonal to the polarization direction. That is, as illustrated in FIG. 7, by applying the electric field E so as to use a region F in the butterfly curve illustrating a relationship of S (an electric field induced strain (a displacement amount)) between E (an electric field) of the piezoelectric layer 70, the piezoelectric layer 70 can be expanded in the −Z-direction, which is an electric field direction, and can be contracted in an in-plane direction including the X-direction and the Y-direction, which are directions orthogonal to the polarization direction.

The piezoelectric layer 70 is contracted in the in-plane direction including the X-direction and the Y-direction, so that the piezoelectric actuator 300 deflects and is deformed in the −Z-direction, which is a side opposite to the pressure chamber 12. In the present embodiment, as illustrated in FIG. 8, by the expansion element P2, the piezoelectric actuator 300 deflects and is deformed so as to have a convex shape toward the −Z side, which is a side opposite to the pressure chamber 12. Of course, by the expansion element P2, the piezoelectric actuator 300 may be deformed so that only a protrusion amount is reduced while remaining in the convex shape on the +Z side which is the pressure chamber 12 side.

In this manner, the expansion element P2 according to the present embodiment deforms the piezoelectric actuator 300 in a direction in which the volume of the pressure chamber 12 is expanded, so that a meniscus in the nozzle 21 is drawn into the pressure chamber 12 side and ink is supplied from the common liquid chamber 35 side to the pressure chamber 12.

In the present embodiment, since the expansion element P2 applies the drive voltage V having 30 V from the first potential $V_1$ (10 V) to the second potential $V_2$ (−20 V) to the piezoelectric actuator 300, a volume of ink drawn from the common liquid chamber 35 into the pressure chamber 12 can be increased. That is, when the volume of the pressure chamber 12 before the expansion of the pressure chamber 12 by the expansion element P2 is a reference volume when a voltage is not applied to the piezoelectric actuator 300, the drive voltage V having 20 V is only applied to the piezoelectric actuator 300 by the expansion element P2. In the present embodiment, the volume of the pressure chamber 12 before the pressure chamber 12 is expanded by the expansion element P2 is made smaller than the reference volume, so that the volume of the ink drawn from the common liquid chamber 35 into the pressure chamber 12 can be increased by the expansion element P2. Therefore, when the volume of the pressure chamber 12 is rapidly contracted by the first contraction element P4 to eject ink droplets from the nozzles 21, a weight of the ejected ink droplet can be increased.

The expansion maintaining element P3 continues to apply the second potential $V_2$ (here, −20 V) to the piezoelectric actuator 300, and maintains the volume of the pressure chamber 12 expanded by the expansion element P2 for a certain period.

The first contraction element P4 applies the second potential $V_2$ to the ground (GND) to the piezoelectric actuator 300 so as to contract the pressure chamber 12 expanded by the expansion maintaining element P3 up to a reference volume when no potential is applied.

As illustrated in FIG. 8, the pressure chamber 12 is rapidly contracted from a volume expanded by the expansion maintaining element P3 up to the reference volume by the first contraction element P4, ink inside the pressure chamber 12 is pressurized and the ink droplet is ejected from the nozzle 21. Since a volume of the ink drawn into the pressure chamber 12 is large in the expansion element P2 before the first contraction element P4, it is possible to increase a weight of the ink droplet ejected from the nozzle 21 by the first contraction element P4. That is, since a pressure change in the ink in the pressure chamber 12 caused by the expansion element P2 is large, a larger pressure change occurs in the pressure chamber 12 when the pressure change of the ink inside the pressure chamber 12 is caused by the first contraction element P4, and the weight of the ejected ink droplet can be increased.

The reference volume maintaining element P5 maintains a state in which no potential is applied to the piezoelectric actuator 300 for a certain period and maintains the reference volume for the certain period.

By the reference volume maintaining element P5, the state in which the pressure chamber 12 is contracted up to the reference volume is maintained for the certain period, and the ink pressure inside the pressure chamber 12 reduced by the ejection of ink droplets during this period is attenuated by repeating an increase and a decrease due to natural vibration of the ink.

The second contraction element P6 applies the ground (GND) to the first potential $V_1$ (10 V) to the piezoelectric actuator 300 so as to contract the volume of the pressure chamber 12 from the reference volume.

The second contraction maintaining element P7 maintains the volume of the pressure chamber 12 in a state of being contracted from the reference volume by applying a first potential $V_1$ (here, 10 V) to the piezoelectric actuator 300.

In the same manner as the first contraction maintaining element P1, an absolute value of the first potential $V_1$ in the second contraction element P6 and the second contraction maintaining element P7 may not exceed a potential which becomes a coercive electric field of the piezoelectric layer 70, so-called an absolute value of the coercive potential Vc ($0<|V_1|\leq|Vc|$).

The second contraction element P6 may supply ink pressure inside the pressure chamber 12 reduced by the first contraction element P4 in accordance with a timing when the ink pressure in the pressure chamber 12 is increased again by the natural vibration period by the reference volume maintaining element P5. As a result, the vibration of the meniscus after the ink droplet is ejected can be attenuated in a short time.

With such a drive signal 250, it can be said that the first potential $V_1$ is applied as an intermediate potential to the first contraction maintaining element P1 and the second contraction maintaining element P7 in a standby state in which ink droplets are not ejected.

As described above, the ink jet recording apparatus I which is a liquid ejecting apparatus according to Embodiment 1 of the present disclosure includes the ink jet recording head 1 which is a liquid ejecting head including the flow path formation substrate 10 in which the pressure chamber 12 communicating with the nozzle 21 is formed, the vibration plate 50 formed on one surface side of the flow path formation substrate 10, and the piezoelectric actuator 300 having the first electrode 60, the piezoelectric layer 70, and the second electrode 80 formed on a surface side of the vibration plate 50 opposite to the flow path formation substrate 10, and the printer controller 210 and the drive circuit 120 which are drive units which supply the drive signal 250 for driving the piezoelectric actuator 300, in which the piezoelectric actuator 300 includes the active portion 310 in which the piezoelectric layer 70 is interposed between the first electrode 60 and the second electrode 80, when viewed from the Z-direction, which is a stacking direction of the first electrode 60, the piezoelectric layer 70, and the second electrode 80, in plan view, the active portion 310 extends from the edge portion B, which is a region other than the central portion A of a region facing the pressure chamber 12, to the outside of the pressure chamber 12, and the drive signal 250 includes the first contraction maintaining element P1 which is a contraction element that contracts the pressure chamber 12 from a reference volume of the pressure chamber 12 when no electric field is applied to the piezoelectric layer 70, and the expansion element P2 that expands the pressure chamber 12 contracted by the first contraction maintaining element P1.

In this manner, by providing the first contraction maintaining element P1 which contracts the pressure chamber 12 below the reference volume before the expansion element P2 which expands the pressure chamber 12 as the drive signal 250 which drives the piezoelectric actuator 300 having the active portion 310 extending from the edge portion B other than the central portion A to the outside of the pressure chamber 12, the expansion element P2 can greatly deform the vibration plate 50 to increase the volume change in the pressure chamber 12. Therefore, when the pressure chamber 12 is contracted from the expansion element P2 and an ink droplet, which is a liquid droplet, is ejected from the nozzle 21, it is possible to increase a weight of the ink droplet.

Further, by providing the first contraction maintaining element P1 in the drive signal 250, it is not necessary to control initial deflection of the vibration plate 50. Therefore, since the initial deflection of the vibration plate 50 has a convex shape toward the pressure chamber 12, it is not necessary to dispose a member having patterned tensile stress, which is not a beam shape, in a member forming the vibration plate 50 and it is possible to suppress the vibration plate 50 from being broken when the tensile stress is applied to the vibration plate 50.

Further, since the weight of the ink droplet ejected from the nozzle 21 can be increased by the drive signal 250, it is not necessary to widen a width of the pressure chamber 12 in the X-direction so as to increase the volume of the pressure chamber 12 and it is possible to suppress the vibration plate 50 from being broken by expanding the pressure chamber 12 in the X-direction. Further, since it is not necessary to widen the width of the pressure chamber 12 in the X-direction, the pressure chambers 12 can be arranged at a high density in the X-direction, and it is possible to downsize the recording head 1 in the X-direction and to realize printing with high accuracy by arranging the nozzles 21.

Further, in the ink jet recording apparatus I which is a liquid ejecting apparatus according to the present embodiment, the first contraction maintaining element P1, which is a contraction element, may apply an electric field opposite to an electric field of the expansion element P2 to the piezoelectric layer 70. With this configuration, the first contraction maintaining element P1 can easily contract the pressure chamber 12 below a reference volume only by applying the electric field in an opposite direction to the expansion element P2 to the piezoelectric layer 70.

In addition, in the ink jet recording apparatus I which is the liquid ejecting apparatus according to the present embodiment, the first potential $V_1$, which is a potential of the first contraction maintaining element P1 which is a contraction element, may be always applied in a standby state. With this configuration, the first potential $V_1$ can be continuously applied as an intermediate potential of the piezoelectric actuator 300, and the drive signal 250 can be simplified.

Further, in the ink jet recording apparatus I which is the liquid ejecting apparatus according to the present embodiment, the absolute value of the first potential $V_1$ which is a potential applied to the piezoelectric actuator 300 by the first contraction maintaining element P1 which is a contraction element may be smaller than an absolute value of a coercive potential, which is a potential which becomes a coercive electric field of the piezoelectric layer 70. With this configuration, it is possible to suppress the inversion of the polarization of the piezoelectric layer 70 by the first contraction maintaining element P1 and efficiently deform the piezoelectric layer 70.

Further, in the ink jet recording apparatus I which is the liquid ejecting apparatus according to the present embodiment, a direction of polarization or a dipole remaining inside the piezoelectric layer when no potential is applied to the piezoelectric actuator 300 is from the first electrode 60 to the second electrode 80 in the −Z-direction, and in the first contraction maintaining element P1 which is a contraction element, a potential of the second electrode 80 may be set to be positive, and in the expansion element P2, a potential of the second electrode 80 may be set to be negative. With this configuration, in the first contraction maintaining element P1, by applying a positive potential to the second electrode 80, the piezoelectric actuator 300 is deformed toward the pressure chamber 12 side, and the pressure chamber 12 can contract below the reference volume. Further, in the expansion element P2, by applying a negative potential to the second electrode 80, the piezoelectric actuator 300 can be deformed to a side opposite to the pressure chamber 12, and the pressure chamber 12 can be expanded more than the reference volume.

Further, in the ink jet recording apparatus I which is the liquid ejecting apparatus according to the present embodiment, the drive signal 250 may further include the first contraction element P4 which is a second contraction element that contracts the pressure chamber 12 expanded by the expansion element P2 up to a reference volume after the expansion element P2, the reference volume maintaining element P5 that maintains the pressure chamber 12 at the reference volume for a certain period after the first contraction element P4, and the second contraction element P6 which is a third contraction element that contracts the pressure chamber 12 from the reference volume. With this configuration, by using the ground (GND) potential in the first contraction element P4 and the reference volume maintaining element P5, it is possible to easily create a constant voltage with an appropriate waveform, and to stabilize the ejection.

Further, in the ink jet recording apparatus I which is the liquid ejecting apparatus according to the present embodiment, in the first contraction maintaining element P1 which is a contraction element, the piezoelectric actuator 300 is in a state of being deformed in a convex shape toward the pressure chamber 12 side. With this configuration, a weight of an ink droplet can be increased by deforming the piezoelectric actuator 300 in the convex shape toward the pressure chamber 12 by the first contraction maintaining element P1.

Further, in a method of driving the recording head 1 which is a liquid ejecting head according to the present embodiment, the recording head 1 includes the flow path formation substrate 10 in which the pressure chamber 12 communicating with the nozzle 21 is formed, the vibration plate 50 formed on one surface side of the flow path formation substrate 10, and the piezoelectric actuator 300 having the first electrode 60, the piezoelectric layer 70, and the second electrode 80 formed on a surface side of the vibration plate 50 opposite to the flow path formation substrate 10, in which the active portion 310 in which the piezoelectric layer 70 is interposed between the first electrode 60 and the second electrode 80 is not provided in the central portion A of a region facing the pressure chamber 12 in the piezoelectric actuator 300, and the piezoelectric actuator 300 is driven by the drive signal 250 including the first contraction maintaining element P1 which is a contraction element that contracts the pressure chamber 12 from the reference volume of the pressure chamber 12 when no electric field is applied to the piezoelectric layer 70, and that expansion element P2 that expands the pressure chamber 12 contracted by the first contraction maintaining element P1.

In this manner, by providing the first contraction maintaining element P1 which contracts the pressure chamber 12 below the reference volume before the expansion element P2 which expands the pressure chamber 12 as the drive signal 250 which drives the piezoelectric actuator 300 having the active portion 310 extending from the edge portion B other than the central portion A to the outside of the pressure chamber 12, the expansion element P2 can greatly deform the vibration plate 50 to increase the volume change in the pressure chamber 12. Therefore, when the pressure chamber 12 is contracted from the expansion element P2 and an ink droplet, which is a liquid droplet, is ejected from the nozzle 21, it is possible to increase a weight of the ink droplet.

Further, by providing the first contraction maintaining element P1 in the drive signal 250, it is not necessary to control initial deflection of the vibration plate 50. Therefore, since the initial deflection of the vibration plate 50 has a convex shape toward the pressure chamber 12, it is not necessary to dispose a member having patterned tensile stress, which is not a beam shape, in a member forming the vibration plate 50 and it is possible to suppress the vibration plate 50 from being broken when the tensile stress is applied to the vibration plate 50.

Further, since the weight of the ink droplet ejected from the nozzle 21 can be increased by the drive signal 250, it is not necessary to widen a width of the pressure chamber 12 in the X-direction so as to increase the volume of the pressure chamber 12 and it is possible to suppress the vibration plate 50 from being broken by expanding the pressure chamber 12 in the X-direction. Further, since it is not necessary to widen the width of the pressure chamber 12 in the X-direction, the pressure chambers 12 can be arranged at a high density in the X-direction, and it is possible to downsize the recording head 1 in the X-direction and to realize printing with high accuracy by arranging the nozzles 21.

Embodiment 2

Figure 10:
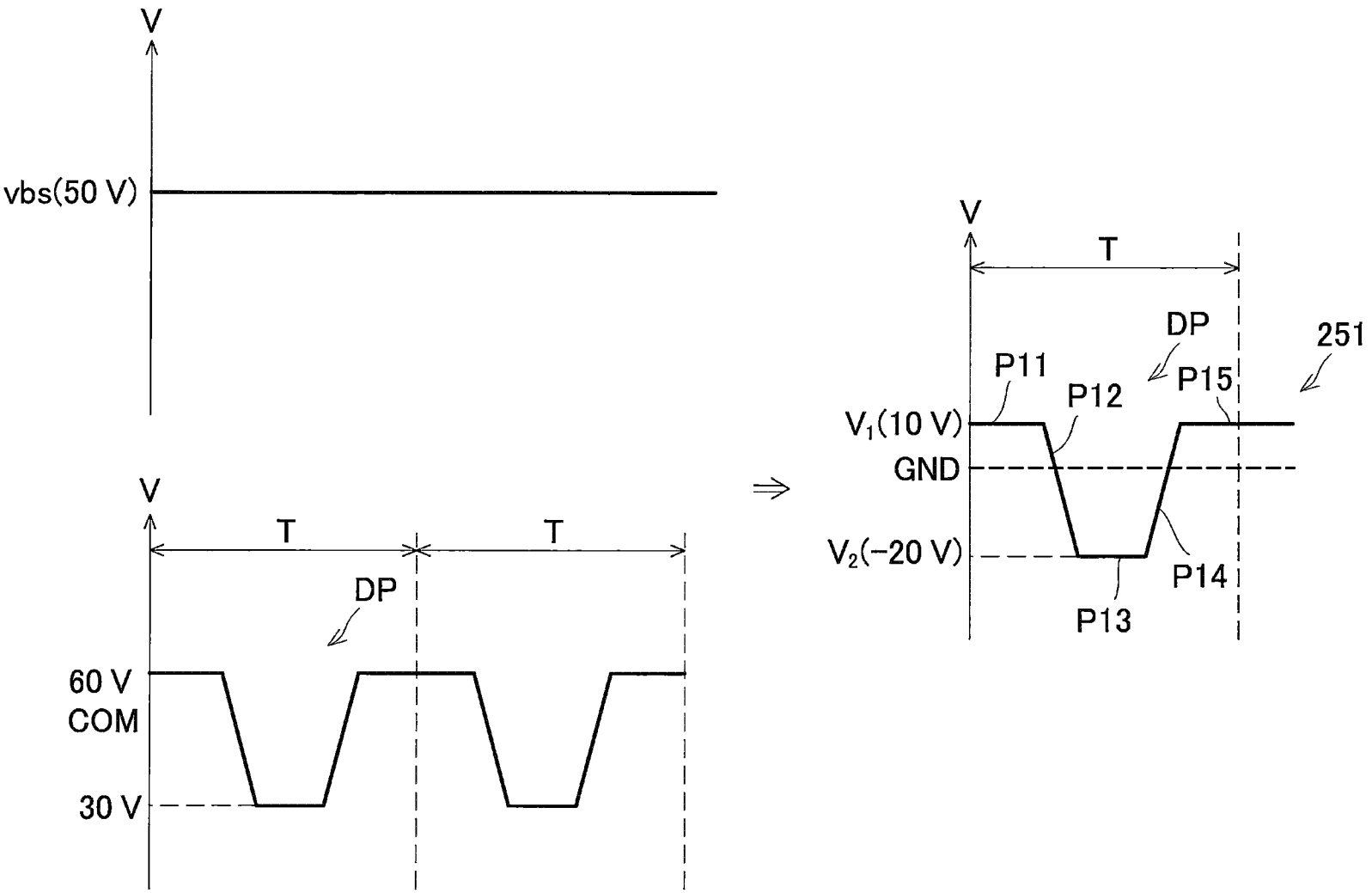
FIG. 10 is a drive waveform illustrating a drive signal according to Embodiment 2.

FIG. 10 is a drive waveform illustrating a bias potential, a common drive signal, and a drive signal according to Embodiment 2 of the present disclosure. The same reference numerals are given to the same members as the embodiment described above and redundant description will be omitted.

As illustrated in FIG. 10, a drive signal 251 to be supplied to the piezoelectric actuator 300 includes a first contraction maintaining element P11, an expansion element P12, an expansion maintaining element P13, a contraction element P14, and a second contraction maintaining element P15.

In the same manner as in the first contraction maintaining element P1 of Embodiment 1, the first contraction maintaining element P11 maintains the volume of the pressure chamber 12 to be in a state of being contracted from the reference volume by applying the first potential $V_1$ (here, 10 V) to the piezoelectric actuator 300. In the present embodiment, the first contraction maintaining element P11 corresponds to a contraction element described in the aspects.

In this manner, by supplying the first contraction maintaining element P11, the piezoelectric actuator 300 can be maintained in a state of being reliably deformed in the +Z-direction, which is the pressure chamber 12 side, regardless of a posture when no potential is applied to the piezoelectric actuator 300, that is, whatever posture the initial deflection is.

Further, in the same manner as in Embodiment 1 described above, an absolute value of the first potential $V_1$ which is a potential applied to the piezoelectric actuator 300 by the first contraction maintaining element P11 may have a size equal to or less than the absolute value of the coercive potential Vc of the piezoelectric layer 70 ($0<|V_1|\leq|Vc|$). In this manner, the absolute value of the first potential $V_1$ is set to a value which does not exceed an absolute value of the coercive potential Vc of the piezoelectric layer 70, so that the first contraction maintaining element P1 can contract the piezoelectric layer 70 in the −Z-direction, which is a polarization direction, without reversing polarization of the piezoelectric layer 70 by the first contraction maintaining element P1.

In the same manner as the expansion element P2 according to Embodiment 1 described above, the expansion element P12 applies the first potential $V_1$ (10 V) to the second potential $V_2$ (here, −20 V), to the piezoelectric actuator 300 so as to expand the volume of the pressure chamber 12 from the first contraction maintaining element P11. In the present embodiment, the expansion element P12 corresponds to an expansion element described in the aspects.

In this manner, the expansion element P12 according to the present embodiment deforms the piezoelectric actuator 300 in a direction in which the volume of the pressure chamber 12 is expanded, so that a meniscus in the nozzle 21 is drawn into the pressure chamber 12 side and ink is supplied from the common liquid chamber 35 side to the pressure chamber 12.

In the present embodiment, since the expansion element P12 applies the drive voltage V having 30 V from the first potential $V_1$ (10 V) to the second potential $V_2$ (−20 V) to the piezoelectric actuator 300, a volume of the ink drawn from the common liquid chamber 35 into the pressure chamber 12 can be increased.

In the same manner as the expansion maintaining element P3 according to Embodiment 1 described above, the expansion maintaining element P13 continues to apply the second potential $V_2$ (here, −20 V) to the piezoelectric actuator 300 for a certain period, and maintains the volume of the pressure chamber 12 expanded by the expansion element P12 for a certain period.

The contraction element P14 applies the second potential $V_2$ (−20 V) to the first potential $V_1$ (10 V) to the piezoelectric actuator 300 so as to rapidly contract the pressure chamber 12 and eject an ink droplet from the nozzle 21. Since a volume of the ink drawn into the pressure chamber 12 in the expansion element P12 before the contraction element P14 is large, a weight of the ink droplet ejected from the nozzle 21 by the contraction element P14 can be increased.

Further, in the contraction element P14, the piezoelectric actuator 300 is deformed from the second potential $V_2$ to the first potential $V_1$ so as to contract the pressure chamber 12, so that the potential to be applied to the piezoelectric actuator 300 is larger than the first contraction element P4 according to Embodiment 1 described above, and a displacement amount of the piezoelectric actuator 300 can be increased. Therefore, the contraction element P14 can increase the weight of the ink droplet ejected from the nozzle 21.

The second contraction maintaining element P15 maintains the contracted volume of the pressure chamber 12 from the reference volume by applying the first potential $V_1$ (here, 10 V) to the piezoelectric actuator 300.

The first potential $V_1$ is higher than 0 V and equal to or less than the coercive potential Vc, and when a potential within this range is applied to the piezoelectric layer 70, an elastic modulus of the piezoelectric layer 70 is increased. Therefore, residual vibration of the ink in the second contraction maintaining element P15 can be quickly suppressed. Therefore, a drive frequency can be increased, that is, one recording cycle T can be shortened.

In the same manner as the first contraction maintaining element P11, an absolute value of the first potential $V_1$ in the second contraction maintaining element P15 may not exceed a potential which becomes a coercive electric field of the piezoelectric layer 70, so-called an absolute value of a coercive potential.

With such the drive signal 251, it can be said that the first potential $V_1$ is applied as an intermediate potential to the first contraction maintaining element P11 and the second contraction maintaining element P15 in a standby state in which ink droplets are not ejected.

Even in the ink jet recording apparatus I according to the present embodiment as described above, by providing the first contraction maintaining element P1 which contracts the pressure chamber 12 below the reference volume before the expansion element P2 which expands the pressure chamber 12 as the drive signal 250 which drives the piezoelectric actuator 300 having the active portion 310 extending from the edge portion B other than the central portion A to the outside of the pressure chamber 12, the expansion element P2 can greatly deform the vibration plate 50 to increase the volume change in the pressure chamber 12. Therefore, when the pressure chamber 12 is contracted from the expansion element P2 and an ink droplet, which is a liquid droplet, is ejected from the nozzle 21, it is possible to increase a weight of the ink droplet.

Further, by providing the first contraction maintaining element P1 in the drive signal 250, it is not necessary to control initial deflection of the vibration plate 50. Therefore, since the initial deflection of the vibration plate 50 has a convex shape toward the pressure chamber 12, it is not necessary to dispose a member having patterned tensile stress, which is not a beam shape, in a member forming the vibration plate 50 and it is possible to suppress the vibration plate 50 from being broken when the tensile stress is applied to the vibration plate 50.

Further, since the weight of the ink droplet ejected from the nozzle 21 can be increased by the drive signal 250, it is not necessary to widen a width of the pressure chamber 12 in the X-direction so as to increase the volume of the pressure chamber 12 and it is possible to suppress the vibration plate 50 from being broken by expanding the pressure chamber 12 in the X-direction. Further, since it is not necessary to widen the width of the pressure chamber 12 in the X-direction, the pressure chambers 12 can be arranged at a high density in the X-direction, and it is possible to downsize the recording head 1 in the X-direction and to realize printing with high accuracy by arranging the nozzles 21.

In addition, after the contraction element P14, the second contraction maintaining element P15 continues to apply the first potential $V_1$ so as to contract the piezoelectric layer 70 in a polarization direction, it is possible to increase the elastic modulus of the piezoelectric layer 70 and to quickly suppress residual vibration of the ink. Therefore, a drive frequency can be increased, that is, one recording cycle T can be shortened.

The drive signal 251 according to the present embodiment is configured such that the second contraction maintaining element P15 continuously applies the first potential $V_1$ after an ink droplet is ejected, but the drive signal 251 is not limited to this. Here, a modification example of the drive signal is illustrated in FIG. 11.

Figure 11:
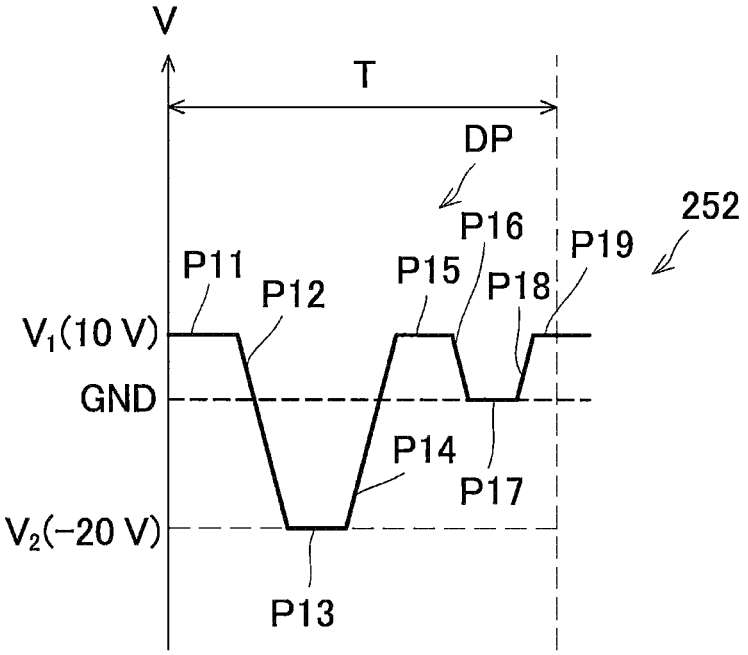
FIG. 11 is a drive waveform illustrating a modification example of the drive signal according to Embodiment 2.

As illustrated in FIG. 11, a drive signal 252 to be supplied to the piezoelectric actuator 300 includes the first contraction maintaining element P11, the expansion element P12, an expansion maintaining element P13, the contraction element P14, the second contraction maintaining element P15, a damping element P16, a reference volume maintaining element P17, a second contraction element P18, and a third contraction maintaining element P19.

The first contraction maintaining element P11 to the second contraction maintaining element P15 have the same manner as in FIG. 10 described above.

Further, the damping element P16 applies the first potential $V_1$ to the ground (GND) to the piezoelectric actuator 300 so as to contract the pressure chamber 12 contracted by the contraction element P14 to a reference volume when no potential is applied. At a timing of applying the damping element P16, that is, an application time of the second contraction maintaining element P15, ink pressure inside the pressure chamber 12 reduced by the contraction element P14 is supplied by the second contraction maintaining element P15 in accordance with a timing when the ink pressure is increased again by the natural vibration period. As a result, the vibration of the meniscus after the ink droplet is ejected can be attenuated in a short time.

After the damping element P16, the reference volume maintaining element P17 maintains the reference volume of the pressure chamber 12 for a certain period.

After that, the volume of the pressure chamber 12 is contracted from the reference volume by the second contraction element P18, and the contracted volume of the pressure chamber 12 is maintained for a certain period by the third contraction maintaining element P19.

Further, in the present embodiment, the drive signals 251 and 252 have one ejection pulse DP within one recording cycle T, but the present embodiment is not limited to this. Here, another modification example of the drive signal according to the present embodiment is illustrated in FIG. 12.

Figure 12:
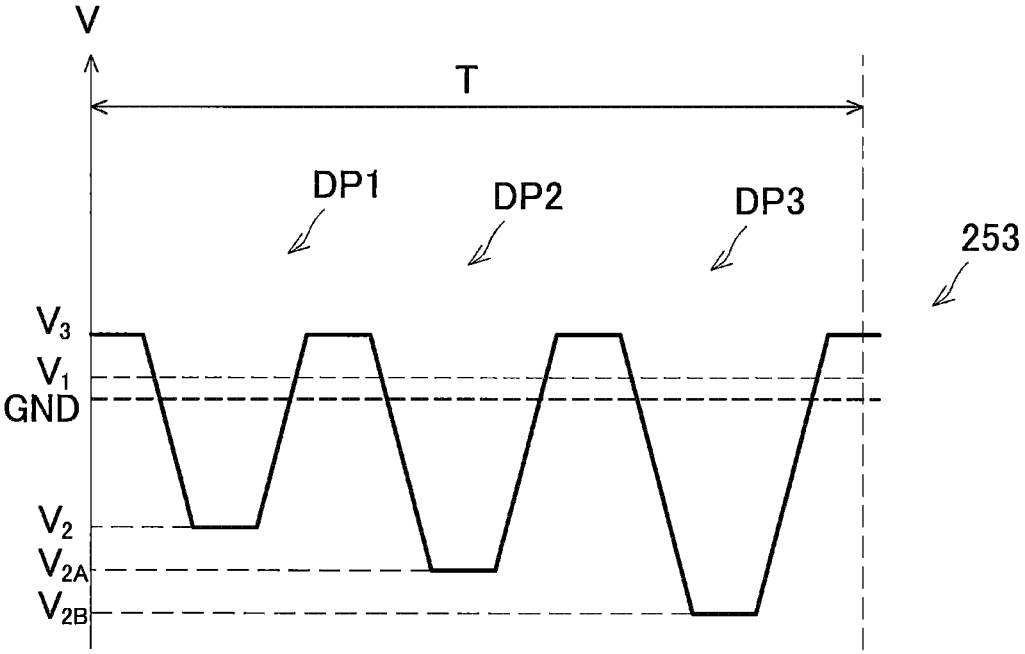
FIG. 12 is a drive waveform illustrating another modification example of the drive signal according to Embodiment 2.

As illustrated in FIG. 12, a drive signal 253 to be supplied to the piezoelectric actuator 300 includes a first ejection pulse DP1, a second ejection pulse DP2, and a third ejection pulse DP3 within one recording cycle T.

Although not particularly illustrated, each of the first ejection pulse DP1, the second ejection pulse DP2, and the third ejection pulse DP3 has a waveform shape in the same manner as the ejection pulse DP of the drive signal 251, and has the waveform shape in which a second voltage which is a minimum voltage is different. That is, each of the first ejection pulse DP1, the second ejection pulse DP2, and the third ejection pulse DP3 includes the first contraction maintaining element P11, the expansion element P12, the expansion maintaining element P13, the contraction element P14, and the second contraction maintaining element P15.

A minimum potential of the first ejection pulse DP1 is the second potential $V_2$. A second potential $V_{2A}$, which is a minimum potential of the second ejection pulse DP2, is smaller than the second potential $V_2$ of the first ejection pulse DP1. Further, a second potential $V_{2B}$, which is a minimum potential of the third ejection pulse DP3, is smaller than the second potential $V_{2A}$ of the second ejection pulse DP2.

When the drive signal 253 including the first ejection pulse DP1, the second ejection pulse DP2, and the third ejection pulse DP3 is applied to the piezoelectric actuator 300 within one recording cycle T, a large dot is formed in one pixel of the recording sheet S.

On the other hand, with the drive signal 251 illustrated in FIG. 10, since one ejection pulse DP is applied to the piezoelectric actuator 300 within one recording cycle T, a small dot is formed in one pixel of the recording sheet S as compared with the drive signal 253.

By selectively using the drive signal 251 and the drive signal 253, a size of a dot formed in one pixel can be used appropriately, and high-speed and high-accuracy printing can be realized.

Further, in the drive signal 253 for forming a large dot, a third potential $V_3$ applied by the first contraction maintaining element P11 of each of the ejection pulses DP1, DP2, and DP3 is set to be larger than the first potential $V_1$ applied by the first contraction maintaining element P11 of the drive signal 251 described above. As a result, a larger dot can be easily formed in one pixel by the drive signal 253.

Incidentally, when a polarization direction of the piezoelectric layer 70 is the +Z-direction or when the first electrode 60 is an individual electrode of each active portion 310, a potential of the drive signal 253 is inverted, so that the third potential $V_3$ needs to be smaller than the first potential $V_1$. That is, an absolute value of the third potential $V_3$ of the first contraction maintaining element P11, which is a contraction element in the drive signal 253, may be smaller than an absolute value of the first potential $V_1$ ($|V_3|>|V_1|$).

Of course, the absolute value of the third potential $V_3$ may be larger than zero (0) and equal to or less than an absolute value of the coercive potential Vc of the piezoelectric layer 70 ($0<|V_3|\leq|Vc|$). In this manner, by setting the absolute value of the third potential $V_3$ to a value which does not exceed the absolute value of the coercive potential Vc of the piezoelectric layer 70, it is possible to suppress polarization of the piezoelectric layer 70 from being inverted even in the drive signal 251.

Further, in the ink jet recording apparatus I, which is a liquid ejecting apparatus according to the present embodiment, in a drive waveform indicating the drive signals 251 and 253 for ejecting ink droplets which are liquid droplets on one pixel, an absolute value of the third potential $V_3$, which is a potential applied to the piezoelectric actuator 300 by the contraction element when inputting a plurality of contraction elements and expansion elements, may be larger than an absolute value of the first potential $V_1$ which is a potential applied to the piezoelectric actuator 300 by the contraction element when inputting one contraction element and expansion element. As a result, a larger dot can be formed in one pixel by the drive signal 253 which applies the third potential $V_3$ to the piezoelectric actuator 300.

Embodiment 3

Figure 13:
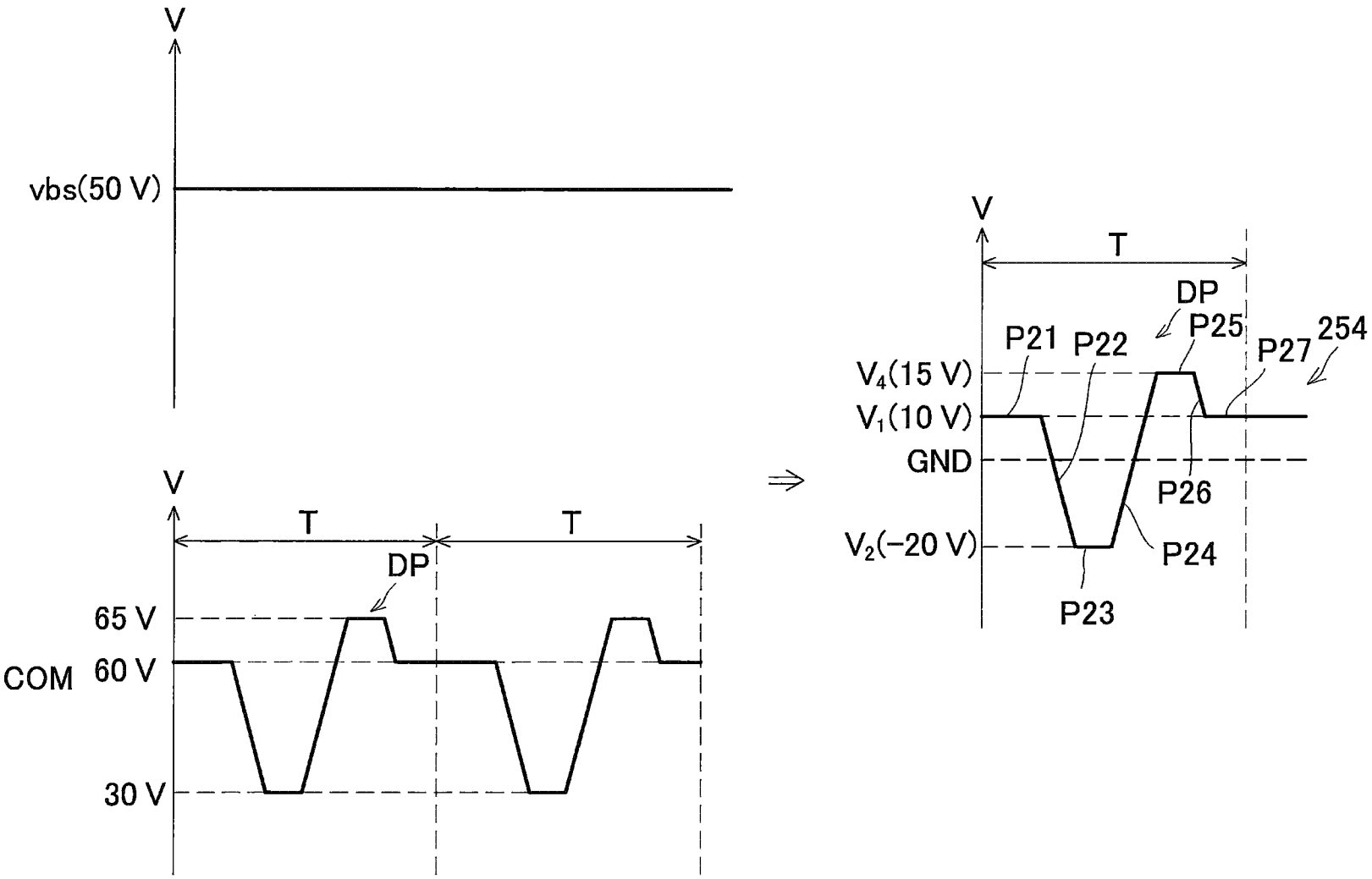
FIG. 13 is a drive waveform illustrating a drive signal according to Embodiment 3.

FIG. 13 is a drive waveform illustrating a bias potential, a common drive signal, and a drive signal according to Embodiment 3 of the present disclosure. The same reference numerals are given to the same members as the embodiment described above and redundant description will be omitted.

As illustrated in FIG. 13, a drive signal 254 supplied to the piezoelectric actuator 300 includes a first contraction maintaining element P21, a first expansion element P22, an expansion maintaining element P23, a contraction element P24, a second contraction maintaining element P25, a return element P26, and a third contraction maintaining element P27.

Each of the first contraction maintaining element P21, the first expansion element P22, and the expansion maintaining element P23 has the same manner as the first contraction maintaining element P1, the expansion element P2, and the expansion maintaining element P3 according to Embodiment 1 described above, and therefore redundant description will be omitted. In the present embodiment, the first contraction maintaining element P21 and the first expansion element P22 respectively correspond to a contraction element and an expansion element described in the aspects.

The contraction element P24 applies the second potential $V_2$ (−20 V) to a fourth potential $V_4$ (here, 15 V) larger than the first potential $V_1$ (10 V) according to Embodiments 1 and 2 described above to the piezoelectric actuator 300, so that the pressure chamber 12 expanded by the expansion maintaining element P23 is contracted up to a volume smaller than a reference volume.

The contraction element P24 pressurizes ink inside the pressure chamber 12 to eject an ink droplet from the nozzle 21. In the present embodiment, the contraction element P24 applies the second potential $V_2$ (−20 V) to the fourth potential $V_4$ (here, 15 V) larger than the first potential $V_1$ (10 V) to the piezoelectric actuator 300, so that the piezoelectric actuator 300 can be deformed more than in Embodiment 2 described above, and a weight of the ink droplet ejected from the nozzle 21 can be further increased.

Incidentally, when a polarization direction of the piezoelectric layer 70 is the +Z-direction or when the first electrode 60 is an individual electrode of each active portion 310, a potential of the drive signal 254 is inverted, so that the fourth potential $V_4$ needs to be smaller than the first potential $V_1$. That is, an absolute value of the fourth potential $V_4$ of the contraction element P24 in the drive signal 254 may be larger than an absolute value of the first potential $V_1$ ($|V_4|>|V_1|$).

In the same manner as in the first potential $V_1$, the absolute value of the fourth potential $V_4$ may be larger than zero (0) and equal to or less than an absolute value of the coercive potential Vc of the piezoelectric layer 70 ($0<|V_4|\leq|Vc|$). In this manner, the absolute value of the first potential $V_1$ is set to a value which does not exceed an absolute value of the coercive potential Vc of the piezoelectric layer 70, so that the contraction element P24 can contract the piezoelectric layer 70 in the −Z-direction, which is a polarization direction, without reversing polarization of the piezoelectric layer 70 by the contraction element P24.

The second contraction maintaining element P25 continues to apply the fourth potential $V_4$ (15 V) to the piezoelectric actuator 300 for a certain period so as to maintain a volume of the pressure chamber 12 contracted by the contraction element P24 for the certain period.

The return element P26 applies the fourth potential $V_4$ (15 V) to the first potential $V_1$ (10 V) to the piezoelectric actuator 300 so as to contract the volume of the pressure chamber 12 to be larger than the volume of the pressure chamber 12 contracted by the second contraction maintaining element P25 and smaller than a reference volume. By supplying the potential in the pressure chamber 12 in accordance with a timing when pressure in the pressure chamber 12 is increased again by the natural vibration period, the return element P26 can damp the vibration of the meniscus after the ink droplet is ejected, in a short time.

The third contraction maintaining element P27 maintains the volume of the pressure chamber 12 in a state of being contracted from the reference volume by applying the first potential $V_1$ (10 V) to the piezoelectric actuator 300.

With such the drive signal 254, it can be said that the first potential $V_1$ is applied as an intermediate potential to the first contraction maintaining element P21 and the third contraction maintaining element P27 in a standby state in which ink droplets are not ejected.

Even in the ink jet recording apparatus I according to the present embodiment as described above, by providing the first contraction maintaining element P1 which contracts the pressure chamber 12 below the reference volume before the expansion element P2 which expands the pressure chamber 12 as the drive signal 250 which drives the piezoelectric actuator 300 having the active portion 310 extending from the edge portion B other than the central portion A to the outside of the pressure chamber 12, the expansion element P2 can greatly deform the vibration plate 50 to increase the volume change in the pressure chamber 12. Therefore, when the pressure chamber 12 is contracted from the expansion element P2 and an ink droplet, which is a liquid droplet, is ejected from the nozzle 21, it is possible to increase a weight of the ink droplet.

Further, by providing the first contraction maintaining element P1 in the drive signal 250, it is not necessary to control initial deflection of the vibration plate 50. Therefore, since the initial deflection of the vibration plate 50 has a convex shape toward the pressure chamber 12, it is not necessary to dispose a member having patterned tensile stress, which is not a beam shape, in a member forming the vibration plate 50 and it is possible to suppress the vibration plate 50 from being broken when the tensile stress is applied to the vibration plate 50.

Further, since the weight of the ink droplet ejected from the nozzle 21 can be increased by the drive signal 250, it is not necessary to widen a width of the pressure chamber 12 in the X-direction so as to increase the volume of the pressure chamber 12 and it is possible to suppress the vibration plate 50 from being broken by expanding the pressure chamber 12 in the X-direction. Further, since it is not necessary to widen the width of the pressure chamber 12 in the X-direction, the pressure chambers 12 can be arranged at a high density in the X-direction, and it is possible to downsize the recording head 1 in the X-direction and to realize printing with high accuracy by arranging the nozzles 21.

In addition, after the contraction element P24, the second contraction maintaining element P25 continues to apply the fourth potential $V_4$ so as to contract the piezoelectric layer 70 in a polarization direction, it is possible to increase the elastic modulus of the piezoelectric layer 70 and to quickly suppress residual vibration of the ink. Therefore, a drive frequency can be increased, that is, one recording cycle T can be shortened.

Other Embodiment

Each of the embodiments of the disclosure is described above, but a basic configuration of the disclosure is not limited to thereto.

Figure 14:
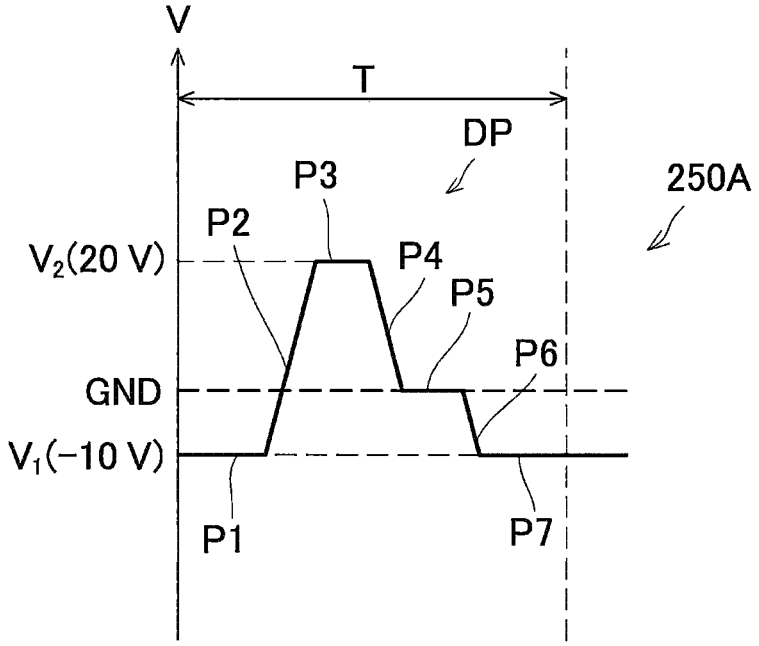
FIG. 14 is a drive waveform illustrating a drive signal according to another embodiment.
Figure 15:
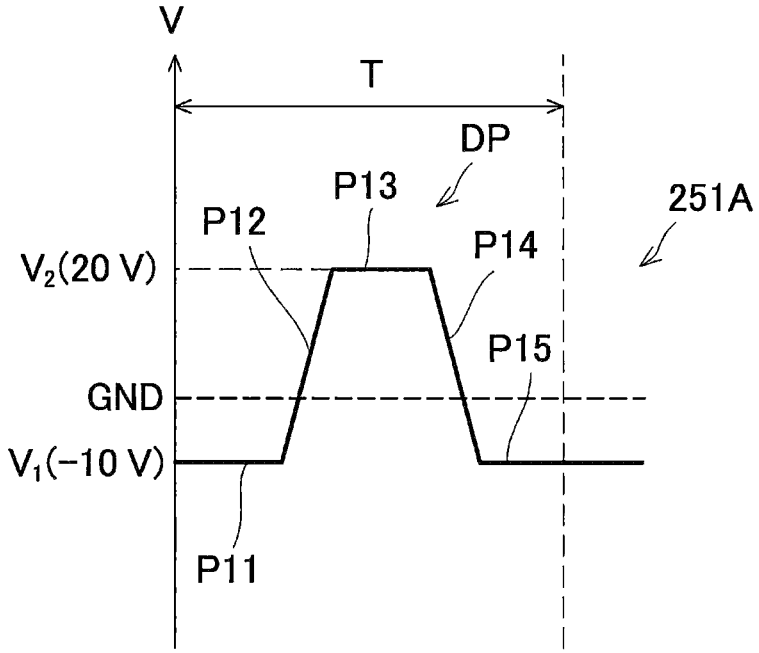
FIG. 15 is a drive waveform illustrating a drive signal according to still another embodiment.

For example, in each of the embodiments described above, the direction of the polarization or dipole of the piezoelectric layer 70 (collectively referred to as the polarization direction) is from the first electrode 60 to the second electrode 80 in the −Z-direction, but the embodiment is not limited thereto. For example, the polarization direction of the piezoelectric layer 70 may be from the second electrode 80 toward the first electrode 60 in the +Z-direction. In this manner, when the polarization direction of the piezoelectric layer 70 is the +Z-direction, the potentials of the drive signals 250 to 254 described above may be inverted. For example, FIG. 14 illustrates a drive signal 250A obtained by inverting the potential of the drive signal 250 in FIG. 7. Further, FIG. 15 illustrates a drive signal 251A obtained by inverting the potential of the drive signal 251 in FIG. 10. That is, as illustrated in FIGS. 14 and 15, in the drive signals 250A and 251A, in the first contraction maintaining elements P1 and P11 which are contraction elements, the first potential $V_1$ is applied so that the second electrode 80 becomes negative (−) based on the first electrode 60. Further, in the expansion elements P2 and P12, the second potential $V_2$ is applied so that the second electrode 80 becomes positive (+) based on the first electrode 60.

As described above, in the ink jet recording apparatus I which is the liquid ejecting apparatus according to the present embodiment, a direction of polarization or a dipole remaining inside the piezoelectric layer 70 when no potential is applied to the piezoelectric actuator 300 is from the second electrode 80 to the first electrode 60 in the +Z-direction, and in the first contraction maintaining elements P1 and P11 which are contraction elements, a potential of the second electrode 80 may be set to be negative, and in the expansion element P2, a potential of the second electrode 80 may be set to be positive. As a result, in the first contraction maintaining elements P1 and P11, by applying a negative potential to the second electrode 80, the piezoelectric actuator 300 is deformed toward the pressure chamber 12 side, and the pressure chamber 12 can contract below the reference volume. Further, in the expansion elements P2 and P12, by applying a positive potential to the second electrode 80, the piezoelectric actuator 300 can be deformed to a side opposite to the pressure chamber 12, and the pressure chamber 12 can be expanded more than the reference volume.

Further, in each of the above-described embodiments, the first electrode 60 is a common electrode of the plurality of active portions 310, the second electrode 80 is an individual electrode of each active portion 310, and the drive signal 250 is supplied to the second electrode 80, but the embodiment is not limited to this. For example, the first electrode 60 may be divided into individual electrodes for each active portion 310, and the second electrode 80 may be a common electrode which is common across the plurality of active portions 310. When the first electrode 60 is the individual electrode, even when the polarization direction of the piezoelectric layer 70 is from the first electrode 60 toward the second electrode 80 in the −Z-direction, a drive signal obtained by inverting the potential of the drive signals 250 to 254, for example, the drive signals 250A and 251A illustrated in FIGS. 14 and 15 may be supplied to the first electrode 60.

Further, in each of the above-described embodiments, the drive signals 250 to 254 for ejecting ink droplets have the contraction element and the expansion element, but the present embodiment is not particularly limited to this, and for a drive signal such as a micro-vibration drive not ejecting ink droplets, the drive signal including a contraction element and an expansion element may be used even in the same manner as in each of the above-described embodiments.

Further, in each of the above-described embodiments, the drive circuit 120 supplies the positive (+) common drive signal COM to the second electrode 80 which is an individual electrode, and the positive (+) bias potential vbs is applied to the first electrode 60 which is a common electrode, so that the drive signals 250 to 254 having a potential difference having positive (+) and negative (−) of the second electrode 80 based on a potential of the first electrode 60 are supplied to the piezoelectric actuator 300, but the present embodiment is not limited to this. For example, the first electrode 60 which is a common electrode is used as a ground (GND), and the drive signals 250 to 254 having positive (+) and negative (−) may be directly supplied from the drive circuit 120 to the second electrode 80 which is an individual electrode. Meanwhile, a drive circuit which supplies a drive signal having only positive (+) is less expensive than a drive circuit configured to supply a drive signal having positive (+) and negative (−). Therefore, as in each of the above-described embodiments, by supplying the drive signals 250 to 254 having positive (+) and negative (−) to the piezoelectric actuator 300 by using the positive (+) common drive signal COM and the plus (+) bias potential vbs, it is possible to use the inexpensive drive circuit 120, and to reduce a cost.

Figure 16:
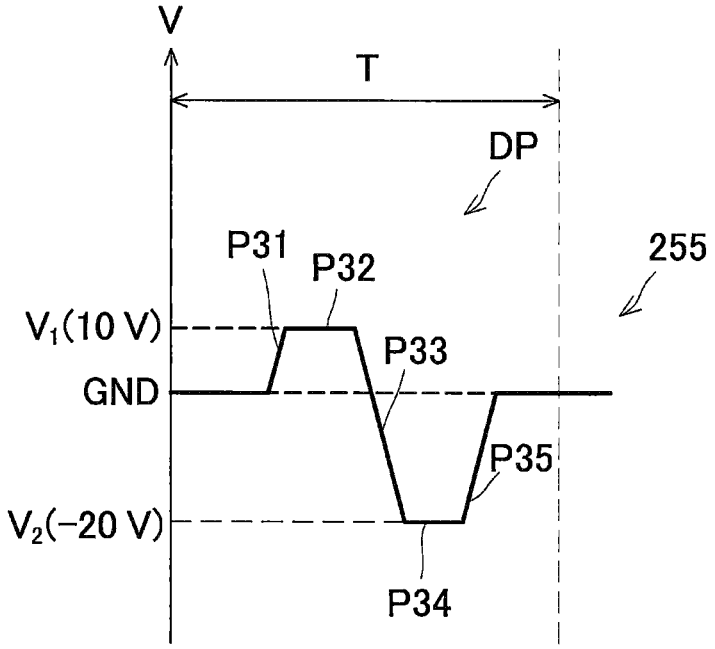
FIG. 16 is a drive waveform illustrating a drive signal according to still another embodiment.

Further, in the drive signals 250 to 254 of each of the above-described embodiments, the first potential $V_1$ is applied as the intermediate potential in the standby state in which ink droplets are not ejected, but the present embodiment is not limited to this. Here, a modification example of the drive signal is illustrated in FIG. 16. FIG. 16 is a drive waveform illustrating a drive signal according to another embodiment.

As illustrated in FIG. 16, the drive signal 255 to be supplied to the piezoelectric actuator 300 includes a first contraction element P31, a contraction maintaining element P32, an expansion element P33, an expansion maintaining element P34, and a second contraction element P35.

The first contraction element P31 applies the ground (GND) to the first potential $V_1$ (here, 10 V) to the piezoelectric actuator 300 so as to contract the pressure chamber 12 below a reference volume.

The contraction maintaining element P32 maintains the contracted volume of the pressure chamber 12 for a certain period. In the example illustrated in FIG. 16, the contraction maintaining element P32 or the first contraction element P31 and the contraction maintaining element P32 correspond to a contraction element described in the aspects.

The expansion element P33 applies the first potential $V_1$ (10 V) to the second potential $V_2$ (here, −20 V), to the piezoelectric actuator 300 so as to expand the volume of the pressure chamber 12 from the contraction maintaining element P32. In the present embodiment, the expansion element P33 corresponds to an expansion element described in the aspects.

The expansion maintaining element P34 continues to apply the second potential $V_2$ (here, −20 V) to the piezoelectric actuator 300, and maintains the volume of the pressure chamber 12 expanded by the expansion element P33 for a certain period.

The second contraction element P35 applies the second potential $V_2$ to the ground (GND) to the piezoelectric actuator 300 so as to rapidly contract the pressure chamber 12 expanded by the expansion maintaining element P34 up to a reference volume when no potential is applied. Pressure of ink inside the pressure chamber 12 is increased by the second contraction element P35, and an ink droplet is ejected from the nozzle 21.

In such a drive signal 255, an intermediate potential is the ground (GND), and the contraction maintaining element P32 which is a contraction element for contracting the pressure chamber 12 up to a volume smaller than the reference volume may be temporarily supplied before the expansion element P33 which expands the pressure chamber 12 below the reference volume so as to eject ink droplets.

In addition, in the example described above, in the ink jet recording apparatus I, the ink cartridge 2 which is a liquid storage unit is mounted on the carriage 3, but the example is not limited thereto. For example, the liquid storage unit such as an ink tank may be fixed to the apparatus main body 4 and the liquid storage unit and the recording head 1 may be coupled via a supply pipe such as a tube. Further, the liquid storage unit may be not mounted on the ink jet recording apparatus.

In addition, in the above-described ink jet recording apparatus I, the recording head 1 is mounted on the carriage 3 and moved in the Y-direction which is a main scanning direction, but the present disclosure is not particularly limited to this, and for example, the present disclosure can also be applied to a so-called line type recording apparatus in which the recording head 1 is fixed and printing is performed only by moving the recording sheet S such as paper in the X-direction which is a sub-scanning direction.

Further, the disclosure is widely applicable to a liquid ejecting head, and can be applied to a recording head such as various ink jet recording heads used in an image recording apparatus such as a printer, a color material ejecting head used for manufacturing a color filter for liquid crystal display and the like, an electrode material ejecting head used for forming an electrode of organic EL displays, field emission display (FED), and the like, a bio-organic substance ejecting head used for manufacturing a biochip, and the like, for example.

What is claimed is:

1. A liquid ejecting apparatus comprising:

a liquid ejecting head that includes a flow path formation substrate in which a pressure chamber communicating with a nozzle is formed, a vibration plate formed on one surface side of the flow path formation substrate, and a piezoelectric actuator having a first electrode, a piezoelectric layer, and a second electrode that are formed on a surface side of the vibration plate opposite to the flow path formation substrate; and a drive unit that supplies a drive signal for driving the piezoelectric actuator, wherein the piezoelectric actuator includes an active portion in which the piezoelectric layer is interposed between the first electrode and the second electrode, in plan view from a stacking direction of the first electrode, the piezoelectric layer, and the second electrode, the active portion is extended from an edge portion, which is a region other than a central portion of a region facing the pressure chamber, to the outside of the pressure chamber, the drive signal includes a contraction element and an expansion element that is applied after the contraction element is applied, the contraction element of the drive signal contracts the pressure chamber from a reference volume by applying a potential difference that is maintained to one of positive or negative, and the expansion element of the drive signal expands the pressure chamber from the reference volume by applying the potential difference that is changed from one of positive or negative to the other of positive or negative, the reference volume is a volume of the pressure chamber when no electric field is applied to the piezoelectric layer, the potential difference is a potential difference of the second electrode based on a potential of the first electrode.

2. The liquid ejecting apparatus according to claim 1, wherein a potential of the contraction element is applied in a standby state.

3. The liquid ejecting apparatus according to claim 1, wherein an absolute value of a potential to be applied to the piezoelectric actuator by the contraction element is larger than zero and is equal to or less than an absolute value of a potential which becomes a coercive electric field of the piezoelectric layer.

4. The liquid ejecting apparatus according to claim 1, wherein in the contraction element, the piezoelectric actuator is in a state of being deformed in a convex shape toward the pressure chamber side.

5. The liquid ejecting apparatus according to claim 1, wherein the expansion element of the drive signal expands the pressure chamber from the reference volume by applying the potential difference that is changed gradually from one of positive or negative to the other of positive or negative over a period of time.

6. A method of driving a liquid ejecting head, the liquid ejecting head including a flow path formation substrate in which a pressure chamber communicating with a nozzle is formed, a vibration plate formed on one surface side of the flow path formation substrate, and a piezoelectric actuator having a first electrode, a piezoelectric layer, and a second electrode that are formed on a surface side of the vibration plate opposite to the flow path formation substrate, in which the piezoelectric actuator includes an active portion in which the piezoelectric layer is interposed between the first electrode and the second electrode, and in plan view from a stacking direction of the first electrode, the piezoelectric layer, and the second electrode, the active portion is extended from an edge portion, which is a region other than a central portion of a region facing the pressure chamber, to the outside of the pressure chamber, the method comprising:

driving the piezoelectric actuator by a drive signal including a contraction element and an expansion element that is applied after the contraction element is applied, the contraction element of the drive signal contracts the pressure chamber from a reference volume by applying a potential difference that is maintained to one of positive or negative, and the expansion element of the drive signal expands the pressure chamber from the reference volume by applying the potential difference that is changed from one of positive or negative to the other of positive or negative, the reference volume is a volume of the pressure chamber when no electric field is applied to the piezoelectric layer, the potential difference is a potential difference of the second electrode based on a potential of the first electrode.

* * * * *